US006527509B2

(12) United States Patent
Kurokawa et al.

(10) Patent No.: US 6,527,509 B2
(45) Date of Patent: Mar. 4, 2003

(54) TURBO MACHINES

(75) Inventors: Junichi Kurokawa, Yokohama (JP); Hitoharu Kimura, Chiyoda-machi (JP); Tomoyshi Okamura, Minori-machi (JP); Takahide Nagahara, Abiko (JP); Sumio Sudo, Chiyoda-machi (JP); Akira Manabe, Chiyoda-machi (JP); Norimitsu Kuwabara, Yasato-machi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/977,208

(22) Filed: Oct. 16, 2001

(65) Prior Publication Data

US 2002/0041805 A1 Apr. 11, 2002

Related U.S. Application Data

(63) Continuation-in-part of application No. 09/399,132, filed on Sep. 20, 1999, now Pat. No. 6,302,643.

(30) Foreign Application Priority Data

Apr. 26, 1999 (JP) ..... 11-117500
Jul. 15, 1999 (JP) ..... 11-201302

(51) Int. Cl.[7] ..... F01D 11/08
(52) U.S. Cl. ..... 415/173.1; 415/914
(58) Field of Search ..... 415/119, 220, 415/221, 914, 196, 173.1, 208.2, 209.3

(56) References Cited

U.S. PATENT DOCUMENTS 3,945,101 A * 3/1976 Rossmanne et al. . 29/156.8 CF
3,982,850 A * 9/1976 Jenkinson ..... 415/178
4,086,022 A * 4/1978 Freeman et al. ..... 415/119
4,239,452 A * 12/1980 Roberts, Jr. ..... 415/172 A
4,466,772 A * 8/1984 Okapuu et al. ..... 415/172 A
4,475,864 A * 10/1984 Patacca et al. ..... 415/9
4,531,362 A * 7/1985 Barry et al. ..... 60/226.1
4,540,335 A * 9/1985 Yamaguchi et al. ..... 415/129
4,714,406 A 12/1987 Hough
4,767,266 A * 8/1988 Holz et al. ..... 415/172
4,781,530 A 11/1988 Lauterbach
5,137,419 A * 8/1992 Waterman ..... 41/170.1
5,267,828 A * 12/1993 Lenhart et al. ..... 415/9
5,466,118 A * 11/1995 Heinrich ..... 415/58.6
5,607,284 A * 3/1997 Byrne et al. ..... 415/58.5
5,683,789 A * 11/1997 Langenbrunner et al. ... 428/209
5,707,206 A * 1/1998 Goto et al. ..... 415/173.1
5,762,470 A * 6/1998 Gelmedove et al. ..... 415/57.4
6,213,711 B1 * 4/2001 Muller et al. ..... 415/191
6,231,301 B1 * 5/2001 Barnett et al. ..... 415/57.4
6,234,747 B1 * 5/2001 Mielke et al. ..... 415/119
6,350,102 B1 * 2/2002 Bailey et al. ..... 415/173.1

* cited by examiner

*Primary Examiner*—Edward K. Look
*Assistant Examiner*—James M McAleenan
(74) *Attorney, Agent, or Firm*—Antonelli, Terry, Stout & Kraus, LLP

(57) ABSTRACT

A turbo machine comprising: an impeller having a plurality of blades therewith; a casing having a flow surface defined therein and being positioned with the impeller therein; and a plurality of grooves being formed in the flow surface of the casing, for connecting between an inlet side of said impeller and an area on the flow surface of the casing in which the blades of said impeller reside. Each groove has a length of at least part of which is oriented in an axial direction of the casing, a width measured in a circumferential direction, and a depth. The width of each groove is equal to or greater than the depth thereof.

26 Claims, 20 Drawing Sheets

CROSS-SECTION OF MIXED-FLOW PUMP

TYPICAL HEAD-FLOW RATE CHARACTERISTIC OF TURBO MACHINE

TURBO MACHINES

This application is a continuation-in-part application of U.S. Ser. No. 09/399,132, filed Sep. 20, 1999 now U.S. Pat. No. 6,302,643.

BACKGROUND OF THE INVENTION

1. Field of the Invention

The present invention relates to turbo machines, and in particular relates to a turbo machine being able to prevent from instability in flow, by suppressing swirl due to recirculation flow at an inlet of an impeller and by suppressing rotation stalls of the impeller, irrespective of the types and the fluid thereof.

In more details, the present invention relates to the turbo machines, such as for a pump, a compressor, a blower, etc., having non-volume type impeller therewith, and in particular, relates to the turbo machine being able to prevent from the instability in flow, by suppressing a swirl or pre-whirl which is generated due to a main flow or component of the recirculation occurring at an inlet of an impeller and by suppressing rotation stalls thereof, thereby being suitable to be applied into a mixed-flow pump, which is used widely as water circulating pumps in a thermal power plant or in a nuclear power plant, a drainage pump, as well as, relates to a pump station into which is applied the turbo machine according to the present invention.

2. Description of Prior Art

Rotary machines being called by a name of "turbo machine" can be classified as below, depending upon the fluids by which the machines are operated and in types thereof.

1. With fluids by which the machine is operated:
   Liquid, and Gas.
2. In Types:
   An axial flow type, a mixed-flow type, and a centrifugal type.

In FIG. 24 showing a cross-section view of a mixed-flow pump which is now mainly or widely used due to easiness in operation thereof, it comprises a suction casing 11, a pump 12 and a diffuser 13, in a sequence from upper stream to down stream thereof.

A blade (of an impeller) 122 rotating within a casing 121 of the pump 12 is rotationally driven on a rotary shaft 123, thereby supplying energy to the liquid which is suctioned from the suction casing 11. The diffuser 13 has a function of converting a portion of velocity (or kinetic) energy of the liquid into static pressure.

FIG. 25 shows a typical characteristic curve between head and flow rate of the turbo machine including the mixed flow pump shown in FIG. 24, where the horizontal axis shows a parameter indicating the flow rate, while the vertical axis a parameter indicating the head.

Namely, the head falls down in reverse relation to increase of the flow rate in a region of low flow rate, however it rises up following the increase of the flow rate during the time when the flow rate lies within a S region (i.e., a portion uprising or jumping up at the right-hand side in the characteristic curve). And, when the flow rate rises up further, exceeding over the right-hand uprising portion of the characteristic curve, the head begins to fall down, again, following the increase in the flow rate.

Then, in a case where the turbo machine is operated with the flow rate of such the characteristic curve of uprising at the right-hand side, a mass of the liquid vibrates by itself, i.e., generating a surging phenomenon.

Such the characteristic curve of uprising at the right-hand side is caused, since the recirculation comes out at an outer edge of the inlet of the impeller when the flow rate flowing through the turbo machine is low, and at that instance, a flow passage or a channel for the liquid flowing into the turbo machine is narrowed, thereby generating a swirl in the liquid (see FIG. 24).

Since the surging gives damages not only upon the turbo machine, but also upon conduits or pipes which are connected to upper stream and down stream sides thereof, it is inhibited to be practiced in a region of low flow rate. Further, there were already proposed various methods for suppressing the surging as below, other than an improvement made in the shape (i.e., profile) of the blade, for the purpose of expanding or enlarging the operation region of the turbo machine.

1. Casing Treatment

Thin or narrow grooves or drains, being from 10% to 20% of a chordal length of the blade, are formed in a casing region where the impeller lies, so as to improve a stall margin.

FIGS. 26(*a*) and (*b*) show explanatory views of the casing treatment which were already proposed, in particular, FIG. 26(*a*) shows a positional relationship between the casing treatment and the blades, and FIG. 26(*b*) shows the cross section views of the casing treatment.

Namely, with the casing treatment which were already proposed, the grooves being sufficient in the depth are formed in an inner wall (i.e., flow surface) of the casing on the region where the blades lie, in an axial direction, in a peripheral direction, or in an oblique direction, alternatively, in a radial direction or an oblique direction, respectively.

Though is not yet investigated clearly the mechanism on how the casing treatment enables the improvement in the stall margin theoretically, it can be considered that because the fluid of high pressure is spouted out or injected into a low energy region and inhibits occurrence of the installing cells.

2. Separator

A separator is provided for dividing the recirculation flow occurring at the outer edge of the inlet of the impeller into a reverse flow portion and a forward flow portion (i.e., in a main flow direction), in the region of low flow rate, thereby prohibiting the expansion of the recirculation.

FIGS. 27(*a*)–(*c*) are explanatory views for the separators, each of which is applied to the turbo machine of the axial flow type, in particular, there are proposed a suction ring type (in FIG. 27(*a*)), a blade separator type (in FIG. 27(*b*)), and an air separator type (in FIG. 27(*c*)), respectively.

In the suction ring type (in FIG. 27(*a*)), the reverse flow is enclosed within an outside of the suction ring, and in the blade separator type (in FIG. 27(*b*)) is provided a fin between the casing and the ring. Further, with the air separator type (in FIG. 27(*c*)), a front end or a tip of the moving wing (i.e., the blade) is opened so as to introduce the reverse flows into the outside of the casing, thereby prohibiting the swirl from being generated due to the reverse flows by means of the fin. Thus, it is more effective, comparing with the former two types mentioned, however, comes to be large-scaled in the devices thereof.

3. Active Control

This is to suppress the generation of the swirl due to the recirculation by injecting or spouting out the high pressure fluid from an outside into a spot where the recirculation occurs.

Furthermore, as an example of the conventional turbo machines, a mixed-flow pump will be described hereinafter. To a mixed-flow pump, it is required to show a head-flow rate characteristic curve (hereinafter, called by "head curve") having no behavior uprising at the right-hand side for enabling a stable operation, in a case where the pump is operated over the whole flow range thereof. However, ordinarily in a pump, it is common that the characteristics, such as an efficiency representing performance of the pump, a stability of the head curve, a cavitation performance, and an axial motive power for closure, etc., are in reversed relationships to one another. Namely, if trying to improve one of those characteristics, the other one(s) is is decreased down, therefore there is a problem that it is difficult to obtain improvements in at least two or more characteristics at the same time. For example, with a pump in which consideration was made primarily onto the efficiency thereof, the head curve shows a remarkable behavior uprising at the right-hand side in a portion thereof, thereby it has a tendency to be unstable.

For obtaining a head curve continuously falling down at the right-hand side for enabling the stable operation, in the conventional arts, as is mentioned in the above, it is already known that the casing treatment or the separator is provided or treated therein. Such the structure is already described, for example in U.S. Pat. No. 4,212,585.

SUMMARY OF THE INVENTION

However, in accordance with the casing treatment and the separators of the prior arts mentioned above, although it is possible to shift the characteristic curve between head and flow rate including the portion uprising at the right-hand side into the lower flow rate side as it is, so as to expand the stable operation region thereof, however it is impossible to remove or cancel such the characteristic or behavior uprising at the right-hand side. Further, the turbo machine is decreased down by approximately 1% in the efficiency thereof, if it rises up by an every 10% in the stall margin, in accordance with the casing treatment.

Also, it is not easy work to machine deep grooves in an inner wall of the casing in the axial direction thereof. Moreover, there is a problem that such the casing treatment cannot be applied to a closed-type impeller having such as a shroud thereabouts.

Further, in such the active control, since there is a necessity to obtain the high pressure fluid from the turbo machine itself or an outside thereof, it is impossible to escape from the decrease in the efficiency of the turbo machine system as a whole.

An object in accordance with the present invention is, for dissolving the drawbacks in the conventional art mentioned in the above, to provide a turbo machine, with which not only removing such the behavior uprising at the right-hand side from the characteristic curve between the head and the flow rate, but also being able to suppress the decrease in the efficiency, i.e., suppressing the swirl generated due to the recirculation occurring at the inlet of the impeller and the rotating stall of thereof.

Namely, an object according to the present invention is to provide a turbo machine which has the head-flow rate characteristic curve without such the behavior of failing down at the right-hand side, as well as can also obtain high efficiency therewith.

Further, another object according to the present invention is to provide a turbo machine, with which can be obtain such the head-flow rate characteristic curve without the behavior of falling down at the right-hand side, as well as can be manufactured with ease.

Furthermore, other object according to the present invention is to provide a turbo machine having the closed-type impeller, with which also can be obtain such the head-flow rate characteristic curve without such the behavior of falling down at the right-hand side.

According to the present invention, for accomplishing the above-mentioned object, there is provided a turbo machine comprising:

a casing having a flow surface defined therein;

an impeller having a plurality of blades and being positioned within said casing;

a plurality of grooves being formed in the flow surface of said casing, for connecting between an inlet side of said impeller and an area in which the blades of said impeller reside, wherein each of said grooves has a length at least part of which is oriented in an axial direction of the casing, a width measured in a circumferential direction, and a depth, and wherein the width of each of said grooves is equal to or greater than the depth thereof.

Also, according to the present invention, for accomplishing the above-mentioned object, there is provided a turbo machine comprising:

a casing having a flow surface defined therein;

an impeller having a plurality of blades and being positioned within said casing;

a plurality of grooves being formed in the flow surface of said casing, for connecting between an inlet side of said impeller and an area in which the blades of said impeller reside, wherein each of said grooves is at least equal to 5 mm or greater than that in a width.

Also, according to the present invention, there is provided a turbo machine comprising:

a casing having a flow surface defined therein;

an impeller having a plurality of blades and being positioned within said casing;

a plurality of grooves being formed in the flow surface of said casing in radial direction thereof, for connecting between an inlet side of said impeller and an area in which the blades of said impeller reside in a gradient direction of fluid pressure therein, wherein each of said grooves is at least equal to 5 mm or greater than that in a width, and a terminal position at downstream side of each of said grooves is located in such a manner that fluid can be obtained under pressure being necessary to suppress generation of swirl at a terminal position of each of said grooves at upstream side thereof.

Further, according to the present invention, there is provided a turbo machine comprising:

a casing having a flow surface defined therein;

an impeller having a plurality of blades and being positioned within said casing;

a large number of shallow grooves being formed in the flow surface of said casing, for connecting between a spot where swirl is generated in a low flow rate of fluid at an inlet side of said impeller and an area in which the blades of said impeller reside in a direction of pressure gradient of the fluid, wherein each of said grooves is at least equal to 5 mm or greater than that in width thereof, and a terminal position at downstream side of each said groove is located in such a manner that fluid can be obtained under pressure being necessary to suppress generation of the swirl at a terminal position at upstream side of each said groove, thereby removing a behavior of uprising at the right-hand side from a head-flow rate characteristic curve of said turbo machine.

Furthermore, according to the present invention, in the turbo machine as defined in the above, wherein said grooves are preferably formed approximately from 30% to 50% in the width thereof, at a ratio with respect to a total circumference length of the casing where the grooves are formed, and are formed approximately from 0.5% to 1.6% in the depth thereof, in more details from 2 mm to 4 mm.

According to the present invention, for accomplishing the above-mentioned object, there is also provided a turbo machine comprising:

an open-type impeller having a plurality of blades therewith;

a casing having a flow surface defined therein and being positioned with said impeller therein;

a plurality of grooves being formed in the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

a bottom surface of each of said grooves is so constructed that it is equal or higher than the flow surface of said casing being adjacent thereto in height thereof.

Further, according to the present invention, there is also provided a turbo machine comprising:

an open-type impeller having a plurality of blades therewith;

a casing having a flow surface defined therein and being positioned with said impeller therein;

a plurality of grooves being formed in the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

the flow surface of said casing being adjacent with a lower flow at a terminal end of each of said grooves is formed so that it is at same level of the bottom surface of each said groove or lies in a direction of an external diameter thereof, the outer periphery to portion of said impeller at the inlet side of the blades thereof opposing to a groove portion is so constructed that it is low in height of the blade thereof corresponding to the groove portion, while the height of the each blade of said impeller in a lower flow side than said grooves is higher than that at the portion opposing to that of said groove portion.

In addition thereto, according to the present invention, there is also provide a turbo machine comprising:

an open-type impeller having a plurality of blades therewith;

a casing having a flow sur face defined therein and being positioned with said impeller therein;

a large number of shallow grooves being formed in the flow surface of said casing, opposing to an outer peripheral portion of said impeller at an inlet side of the blades thereof and being equal or greater than 5 mm in depth thereof, for connecting between a spot where swirl is generated in a low flow rate of fluid at an inlet side of said impeller and an area on the interior surface of said casing in which the blades of said impeller reside in a direction of pressure gradient of the fluid, on a periphery thereof, wherein:

a terminal position at downstream side of each of said grooves is located in such a manner that fluid can be obtained under pressure being necessary to suppress generation of the swirl in inlet main flow at a terminal position of each of said grooves at upstream side thereof, thereby removing a behavior uprising at the right-hand side from a head-flow rate characteristic curve of said turbo machine, and a bottom surface of each said grooves is so constructed that it is equal or higher than the flow surface of said casing being adjacent thereto in a height thereof, as well as the outer periphery portion of said impeller at the inlet side of the blades thereof, opposing to a groove portion, is so constructed that it is low in height at the blades thereof corresponding to that groove portion.

Further, according to the present invention, there is provided a turbo machine comprising:

an open-type impeller having a plurality of blades therewith;

a casing having a conical wall surface therein and being positioned with said impeller therein;

a plurality of grooves being formed in a direction of pressure gradation so as to project from the conical wall surface of said casing, opposing to an outer peripheral portion of said impeller at an inlet side of the blades thereof, wherein:

height of each of the blades on a meridian plane in vicinity of an inlet of said impeller is made to be smaller than that on a meridian plane in vicinity of an outlet of said impeller, and those heights of the blades are determined corresponding to height of a groove portion.

Further, according to the present invention, there is provided a turbo machine comprising:

an open-type impeller having a plurality of blades therewith;

a casing having a flow surface defined therein and being positioned with said impeller therein;

a plurality of grooves being formed in the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

a configuration of flow passage defined with projecting portions of said grooves is so constructed that it is larger than that which is defined in the casing at downstream side of said grooves and is elongated into upstream side as it is, in a distance of a radical direction from a rotation center of a pump;

a tip portion of said impeller is so formed that it defines an approximate constant space between said grooves and the interior surfaces of said casing; and height of each the blades of said impeller in vicinity of a terminal end of said grooves is made higher than that of the blade at downstream side.

Further, according to the present invention, there is also provided a turbo machine comprising:

a closed-type impeller having a plurality of blades and a shroud thereabouts;

a casing having a inner wall and being positioned with said impeller therein, wherein said impeller is formed into an open-type having no shroud thereabouts in vicinity of an inlet of said impeller; and a plurality of grooves in a direction of pressure gradient, being formed on the inner wall of said casing opposing to that portion in vicinity of the inlet of said impeller having no shroud thereabouts, on a periphery thereof, wherein:

a starting end of each of said grooves at an inlet side is positioned at a side being upper in flow than a tip inlet side of said impeller, while a terminating end of said each groove is positioned at a lower flow side than a tip outlet side of said impeller.

Further, according to the present invention, there is also provided a turbo machine comprising:

a closed-type impeller having a plurality of blades and a shroud thereabouts;

a casing having a flow surface defined therein and being positioned with said impeller therein, wherein said impeller is formed into an open-type having no shroud thereabouts in vicinity of an inlet of said impeller; and a large number of shallow grooves being formed in the flow surface of said casing, opposing to an outer peripheral portion of said impeller at an inlet side of the blades thereof and being equal or greater than 5 mm in depth thereof, for connecting between a spot where swirl is generated in a low flow rate of fluid at an inlet side of said impeller and an area on the flow surface of said casing in which the blades of said impeller reside in a direction of pressure gradient of the fluid, on a periphery thereof, wherein:

a terminal position at downstream side of each of said grooves is located in such a manner that fluid can be obtained under pressure being necessary to suppress generation of the swirl in inlet main flow at a terminal position, at upstream side of each of said grooves, thereby removing a behavior of uprising at the right-hand side from a head-flow rate characteristic curve of said turbo machine; and a bottom surface of each of said grooves is so constructed that it is equal or higher than the flow surface of said casing adjacent thereto in height thereof, as well as the outer peripheral portion of said impeller at the inlet side of the blades thereof opposing to a groove portion is so constructed that it is low in height of the blades of said impeller corresponding to that groove portion.

Further, according to the present invention, there is provided a turbo machine as defined in the above, further comprising an axis sealing portion for sealing between a minimum radial portion of the shroud of said impeller and said casing, wherein said axis sealing portion includes a mouth ring portion and a casing ring portion.

Also, according to the present invention, there is also provided a turbo machine comprising:

an impeller having a plurality of blades therewith;

a casing having a flow surface defined therein and being positioned with said impeller therein; and a plurality of grooves being formed on the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

a terminal position at downstream side of each of said grooves is located in such a manner that fluid can be obtained under pressure being necessary to suppress generation of the swirl in inlet main flow at a terminal position, at upstream side of each of said grooves, thereby removing a behavior of uprising at the right-hand side from a head-flow rate characteristic curve of said turbo machine; and a portion of said casing where said grooves are provided is constructed separate from other portion of said casing.

Further, according to the present invention, in the turbo machine as defined in the above, wherein a portion of said casing, on which said grooves are formed, is separately constructed and assembled from other portion of said casing being divided in a radical direction thereof.

Furthermore, according to the present invention, in the turbo machine as defined in the above, wherein said grooves are formed in a direction being inclined from a direction of pump axis to a rotating direction of said impeller, at starting ends thereof.

And, according to the present invention, for accomplishing the above object, there is also provide a turbo machine comprising:

an impeller having a plurality of blades therewith;

a casing having a flow surface defined therein and being positioned with said impeller therein; and a plurality of grooves being formed in the flow surface of said casing, for connecting between an inlet side of said impeller and an area on the interior surface of said casing in which the blades of said impeller reside, on a periphery thereof, wherein an index of determining a form of said grooves is obtained by a following equation:

$$JE\ \text{No.} = WR \times VR \times WDR \times DLDR$$

where,

WR (a width ratio) is a value obtained by dividing a total value of the groove widths W with a length of casing periphery;

VR (a volume ratio) is a value obtained by dividing a total volume of said grooves with a volume of said impeller;

WDR (a width-depth ratio) is a value obtained by dividing the width W of said groove with a depth D of said groove; and DLDR is a ratio between a length of said groove in flow, being lower than the impeller inlet and the depth of said groove, and wherein, said grooves are formed so that the index JE No. lies in a range from 0.03 to 0.5.

Further, according to the present invention, in the turbo machine as defined in the above, wherein said grooves are formed so that the index JE No. lies in a range from 0.15 to 0.2.

Moreover, according to the present invention, for accomplishing another object mentioned above, there is provided a pump station for lifting up a fluid head in a suction side up to a discharge side, comprising:

a pump having an impeller and a casing being positioned with said impeller therein, for pumping up the fluid in the suction side;

a passage for conducting the fluid being pumped up from said pump to the discharge side;

a driver apparatus for ratably driving said impeller of said pump; and controller means for controlling rotation speed of said impeller of said pump, wherein said pump is the pump defined in the above.

Further, according to the present invention, in the pump station as defined in the above, wherein a specific speed Ns is approximately from 1,000 to 1,500 assuming that rotation speed of said pump used in said pump station is N (rpm), a total head H (m), and a discharge flow rate Q ($m^3$/min), and that the specific speed Ns as an index of indicating a pump characteristic is obtained by an equation, $N_s=N\times Q^{0.5}/H^{0.75}$, and when a stationary head being determined by a suction side fluid level and a discharge side fluid level is equal or greater than 50% of a head at a specific point.

Further, according to the present invention, in the pump station as defined in the above, wherein a rotation speed of said driver apparatus is controlled in a control range from 60% to 100% with respect to a reference rotation speed, in a case where said driving apparatus for the pump comprises a speed reduction gear, a fluid coupling and a diesel engine.

Further, according to the present invention, in the pump station as defined in the above, wherein a rotation speed of said driver apparatus is controlled in a control range from 60% to 100% with respect to a reference rotation speed, in a case where said driving apparatus for the pump comprises a speed reduction gear, a fluid coupling and a gas turbine.

And, according to the present invention, in the pump station as defined in the above, wherein a rotation speed of said driver apparatus is controlled in a control range from 0% to 100% with respect to a reference rotation speed, in a case where said driving apparatus for the pump comprises an electric motor for controlling the rotation speed by an inverter.

Also, according to the present invention, there is provided a turbo machine comprising:

an impeller having a plurality of blades therewith;

a casing having a flow surface defined therein and being positioned with said impeller therein; and a plurality of grooves being formed on the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

each of said grooves has a length at least a part of which is oriented in an axial direction of the casing and a width measured in a circumferential direction of the casing of at leas 5 mm, and wherein a terminal position at downstream side of each of said grooves is located in such a manner that fluid can be obtained under pressure being necessary to suppress generation of the swirl in inlet main flow at a terminal position, at upstream side of each of said grooves, thereby removing a behavior of uprising at the right-hand side from a head-flow rate characteristic curve of said turbo machine; and wherein said grooves are defined by a plurality of spaced ribs having a length at least part of which is oriented in the axial direction of the casing, the ribs being constructed separately from the casing and being fixed therein.

Further, according to the present invention, there is provided a method for manufacturing a turbo machine, comprising:

providing a casing having a flow surface defined therein and a channel provided in the flow surface;

providing a plurality of ribs in the channel, each of the ribs being arranged in the channel so as to have a length at least a part of which is oriented in an axial direction of the casing, the ribs being spaced from one another to define a plurality of grooves therebetween, each of the grooves having a length at least a part of which is oriented in the axial direction of the casing and a width measured in a circumferential direction of the casing;

fixing the ribs in the channel; and positioning an impeller having a plurality of blades within the casing such that the plurality of grooves oppose an outer peripheral portion of said impeller at an inlet side thereof, for connecting between an inlet side of said impeller and an area on the flow surface of the casing in which the blades of the impeller reside, on a periphery thereof, wherein a terminal position at a downstream side of each of the grooves is located in such a manner that fluid can be obtained under pressure being necessary to suppress generation of swirl in inlet main flow at a terminal position at an upstream side of each of the grooves, thereby removing a behavior of uprising at the right-hand side from a head-flow rate characteristic curve of the turbo machine.

DETAILED DESCRIPTION OF PREFERRED EMBODIMENTS

Hereinafter, embodiments according to the present invention will be fully explained by referring to the attached drawings.

Figure 1:
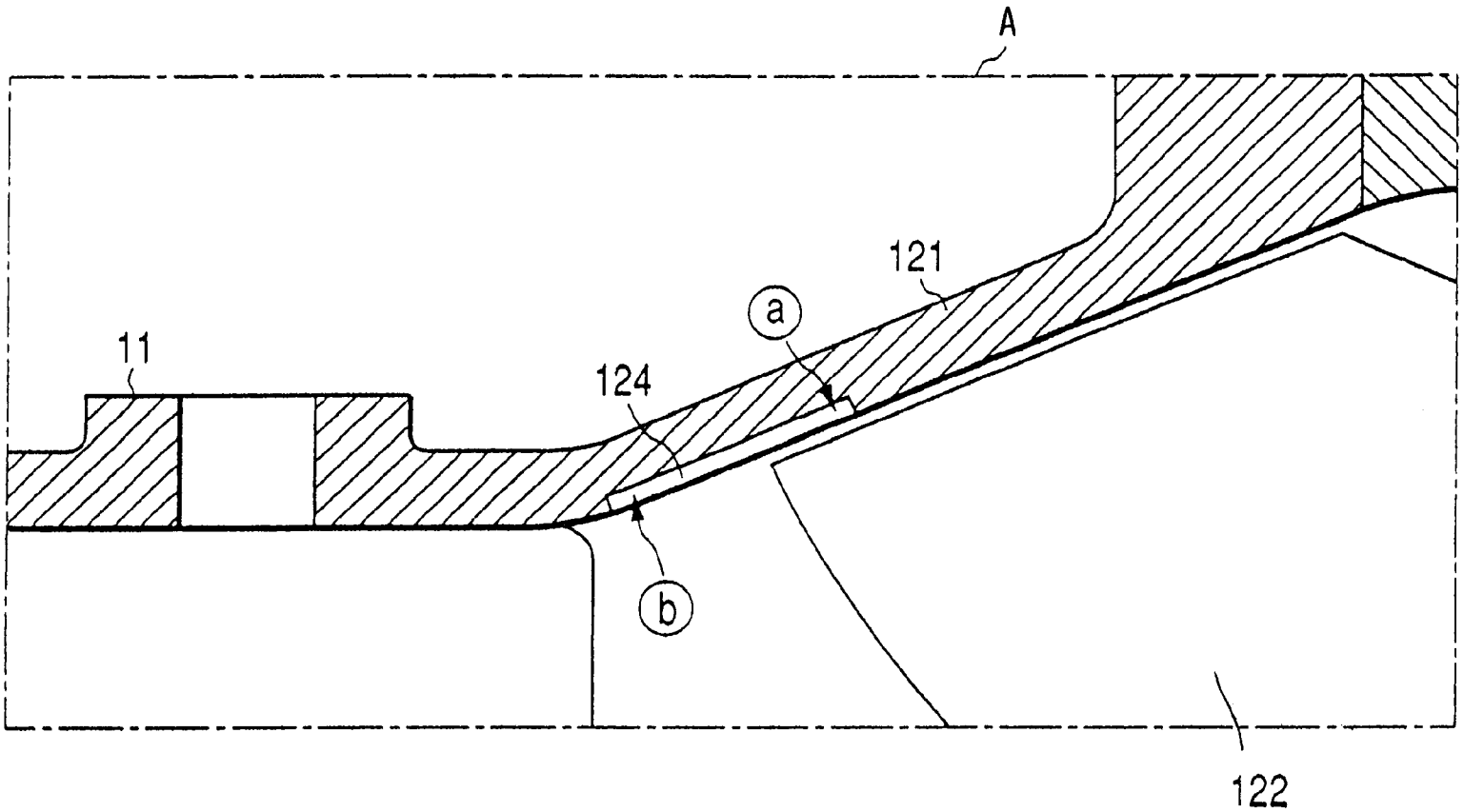
FIG. 1 is an enlarged cross-section view of a mixed-flow pump according to a first embodiment of the present invention.
Figure 24:
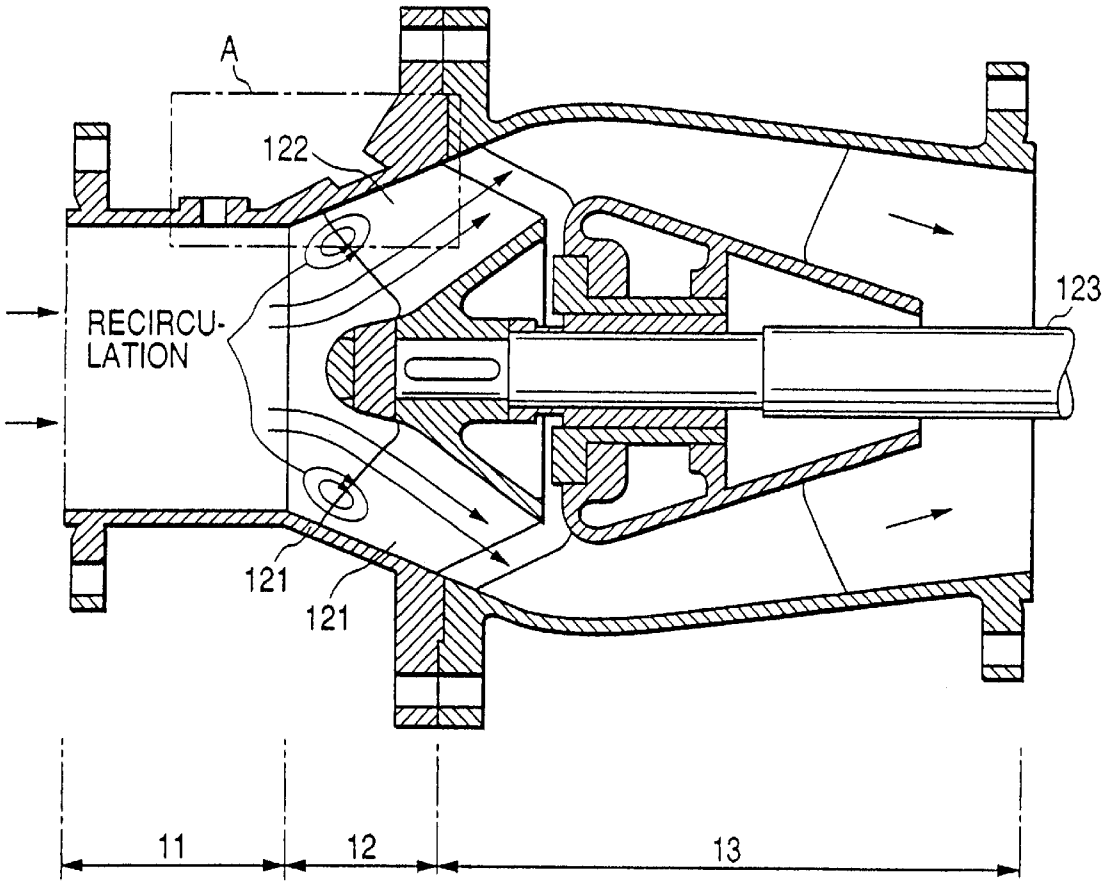
FIG. 24 PRIOR ART
FIG. 24 is a cross-section view of a mixed-flow pump according to the conventional art.
Figure 25:
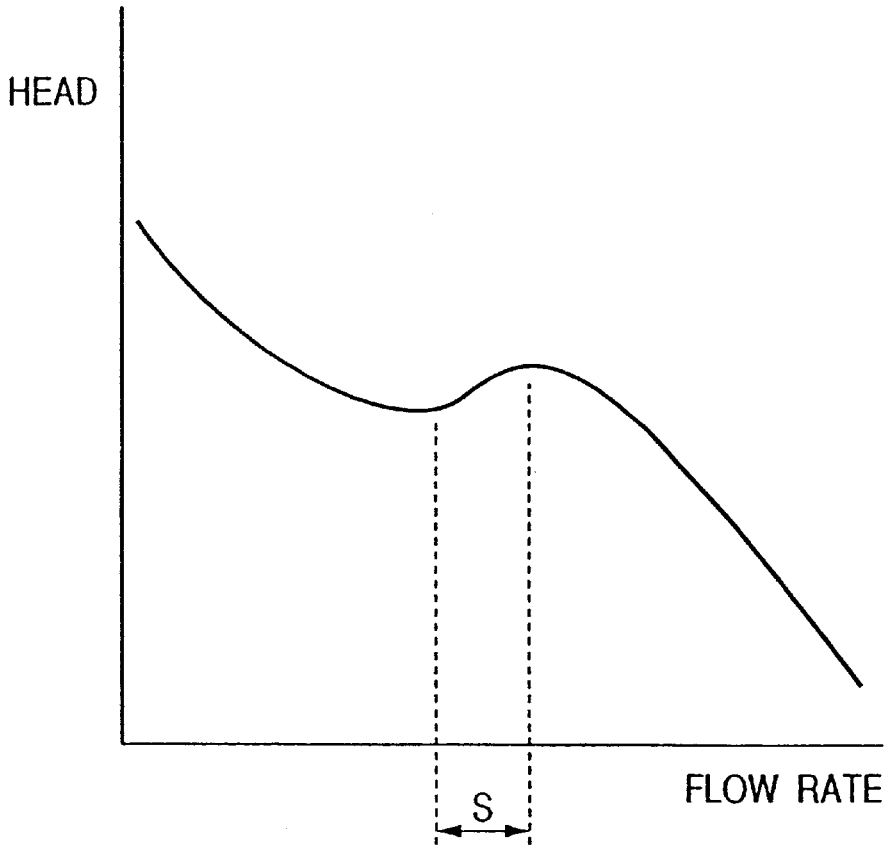
FIG. 25 PRIOR ART
FIG. 25 is a graph of showing a typical head-flow rate characteristic curve of the mixed-flow pump according to the conventional art.
Figure 26A:
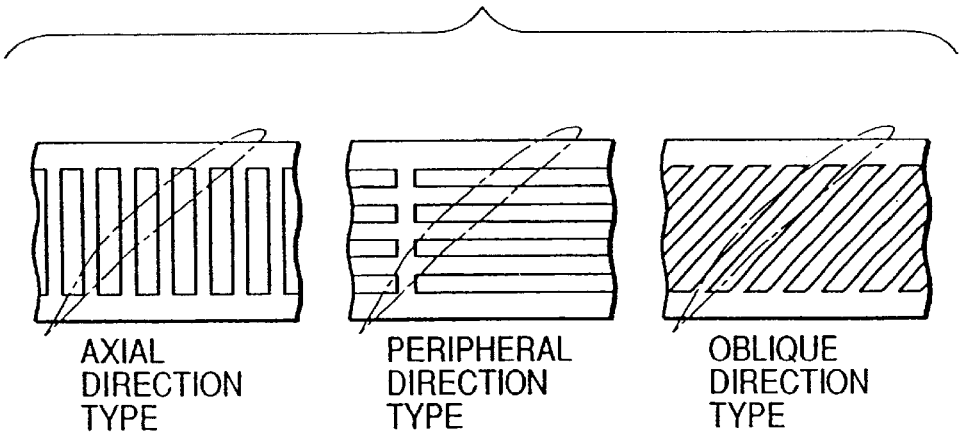
FIG. 26(a) PRIOR ART
FIGS. 26(*a*) and (*b*) are views for explaining casing treatments according to the conventional arts.
Figure 26B:
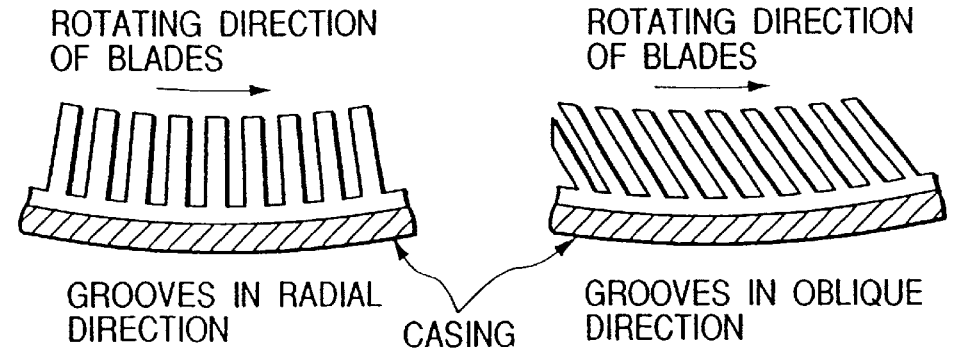
FIG. 26(b) PRIOR ART
Figure 27A:
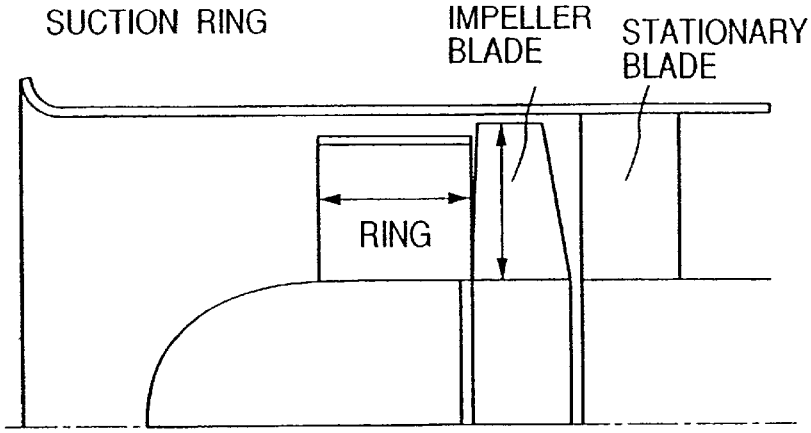
FIG. 27(a) PRIOR ART
FIGS. 27(*a*) through (*c*) are views for explaining separators according to the conventional arts.
Figure 27B:
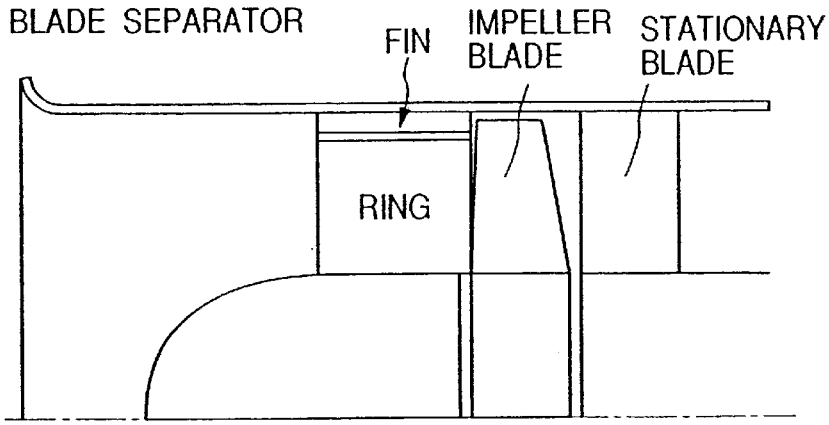
FIG. 27(b) PRIOR ART
Figure 27C:
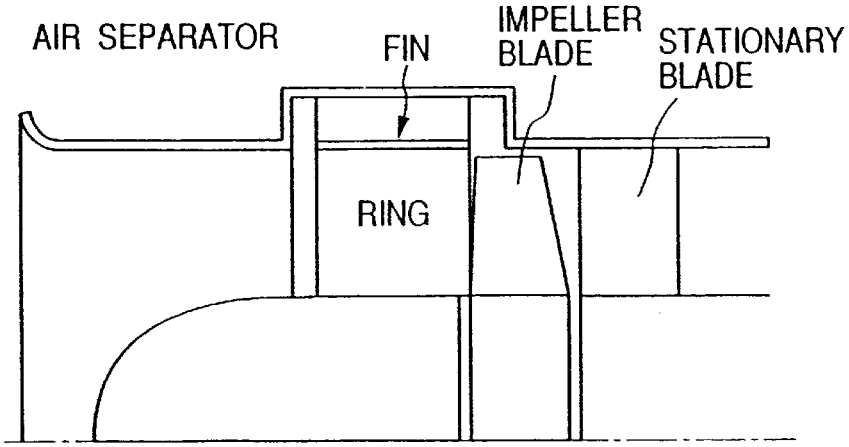
FIG. 27(c) PRIOR ART

FIG. 1 is an enlarged section view of a first embodiment of the present invention, for example, the mixed-flow pump shown in the FIG. 24, and in particular, an enlarged view of a portion which is enclosed by a one-dotted chain line in that Figure.

Namely, in a turbo machine according to the present invention, with which a swirl due to the reverse flow at the blade inlet is suppressed, wherein shallow grooves 124 are formed on a flow surface of the casing 121 along with an inclination of pressure of the fluid (i.e., gradient of pressure), bridging over from a middle portion "a" (i.e., a terminal position of the groove at downstream side) of the blade 122 up to a position "b" (i.e., a terminal position of the groove at upper stream side) where the recirculation occurs in the low flow rate.

Then, the fluid increased in pressure by the blade begins to flows into the reverse direction within the grooves 124, directing from the terminal position "a" at downstream side to the terminal position "b" at the upper stream side, and is injected or sprouted out into the place or spot where the recirculation occurs in the low flow rate, so as to prevent from occurrence of the swirl due to the recirculation, as well as the rotating stall of the impeller.

Figure 2:
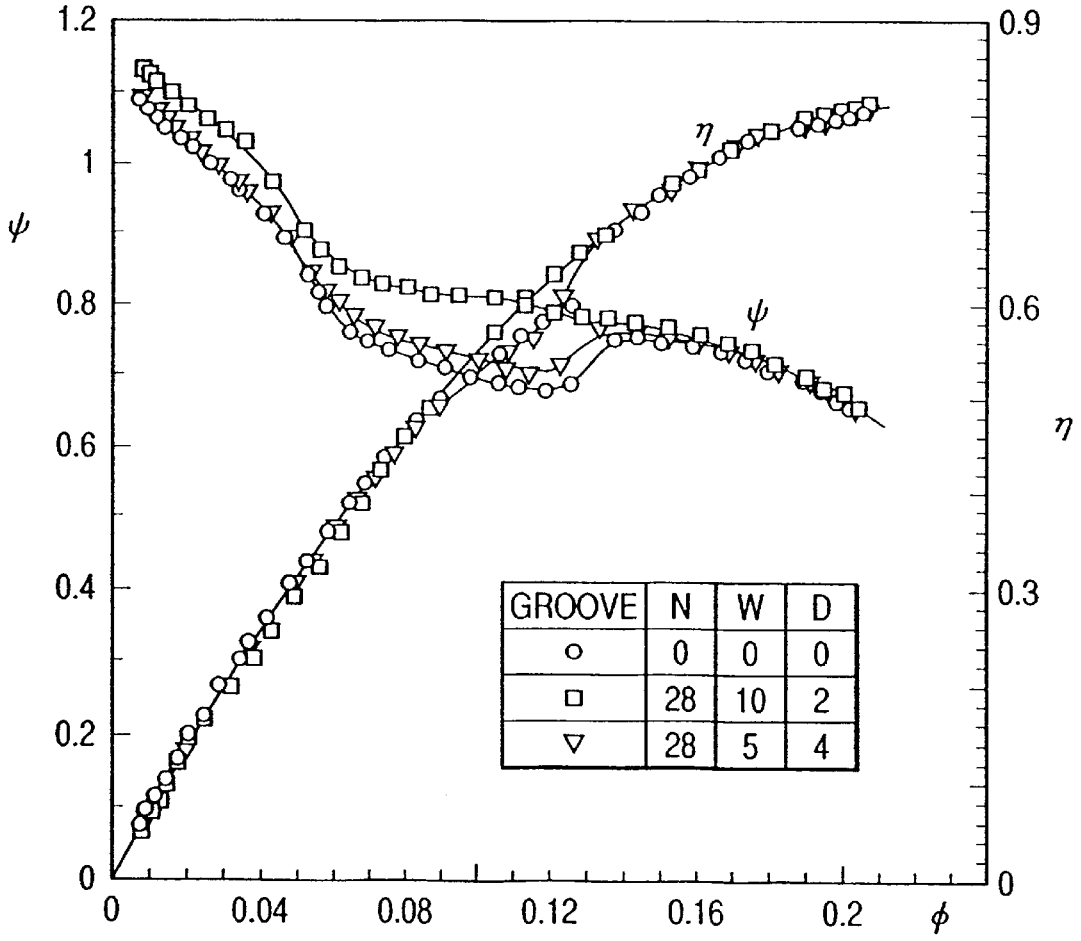
FIG. 2 is an explanatory view of effects of the present invention (a part 1)

FIG. 2 is an explanatory view for showing an effect of the present invention (a part 1), in particular, the effect by forming the grooves. In FIGS. 6 through 9, the horizontal axis indicates the flow rate of fluid, while the vertical axis the head, both without dimensions thereof.

Namely, white circles indicate the characteristic curve of the head-flow rate in a case where no groove is formed in the casing, wherein there still can be seen such a behavior that it upraises or jumps up at the right-hand side, following the increase in the flow rate within a range from 0.12 to 0.14 of the flow rate without dimension.

White triangles and white squares indicate the characteristic curves of the head-flow rate, respectively, in particular, in cases where the grooves are formed in the casing, wherein the white triangles indicate a case where 28 pieces (N=28) of the grooves are formed with 5 mm in the width and 4 mm in the depth are formed, for example, and the white squares indicate a case where also 28 pieces of the grooves are formed, but of 10 mm in the width and 2 mm in the depth.

Apparent from the FIG. 2, the behavior uprising at the right-hand side cannot be dissolved or removed in the case where the grooves of the width and the depth 5×4 mm are formed, however it is completely dissolved in the case where the grooves of the width and the depth 10×2 mm are formed. Namely, it indicates that the shallow and wide grooves are more effective than those being deep in the depth, when forming thereof. However, the FIG. 2 also indicates that, though the efficiency $\eta$ is decreased down due to the reverse flow of fluid within the channels theoretically, it is so small that it practically cannot be acknowledged. Thus, the width of each of the grooves is preferably equal or greater than the depth of each groove.

Figure 3:
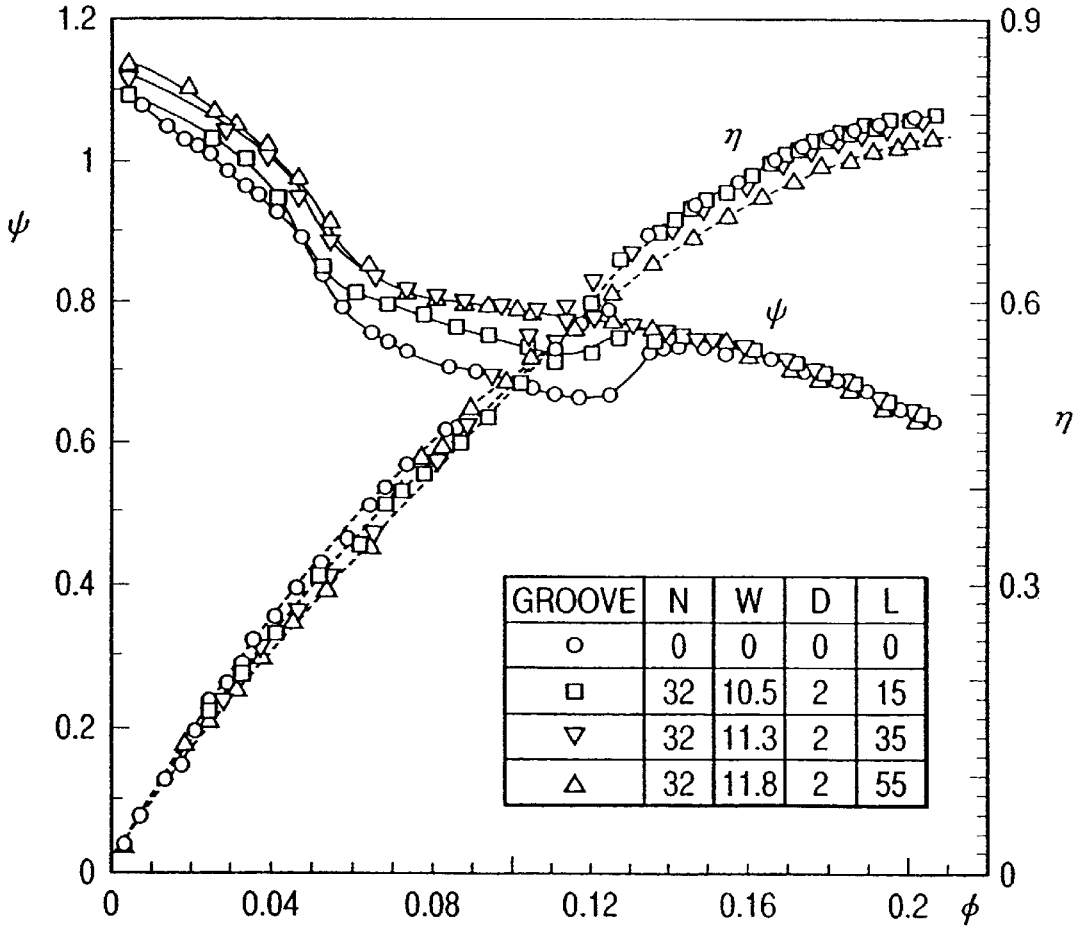
FIG. 3 is an explanatory view of effects of the present invention (a part 2)

FIG. 3 is an explanatory view for showing another effect of the present invention (a part 2), in particular showing influence of length of the grooves.

Namely, it indicates the characteristic curve of the efficiency-flow rate in a case when the terminal position "a" at downstream side is changed, while keeping the terminal position "b" at down stream side fixed, under the condition of maintaining the shape or configuration of the grooves in almost same, wherein the lower the terminal position "a" at downstream side, the better the characteristic curve, i.e., the smaller the behavior of uprising at the right-hand side. However, when it comes to extremely in the downstream side, the efficiency is decreased down because the high pressure fluid is extracted too much, more than that to be necessary.

Figure 4:
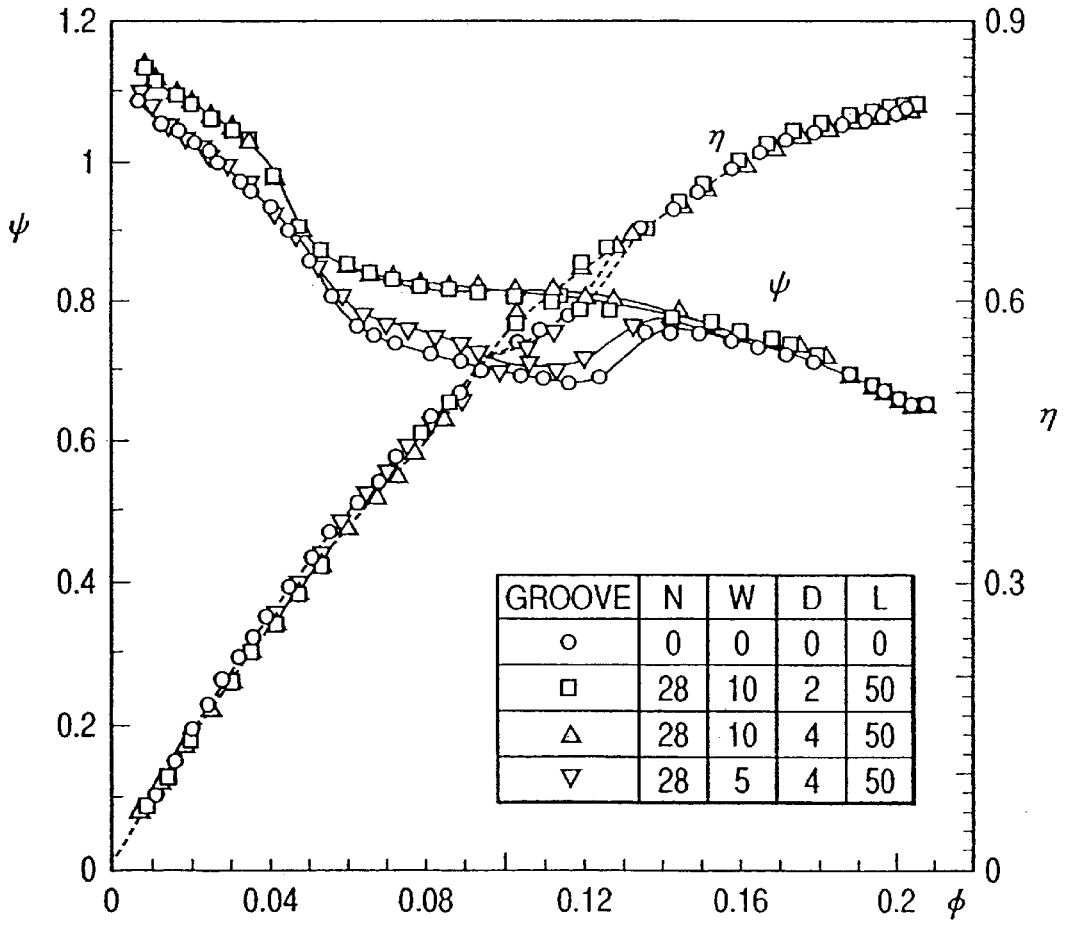
FIG. 4 is an explanatory view of effects of the present invention (a part 3)

FIG. 4 is an explanatory view for showing the other effect of the present invention (a part 3), in particular for showing influences of the depth and the width of the grooves.

Namely, it is indicated that, in a case where the number of the groove(s) is kept to be constant, the depth does not give much influence upon the characteristic curve of the head-flow rate, however, the wider the width, the better the characteristic curve of the head-flow rate, i.e., the behavior uprising at the right-hand side is improved.

Figure 5:
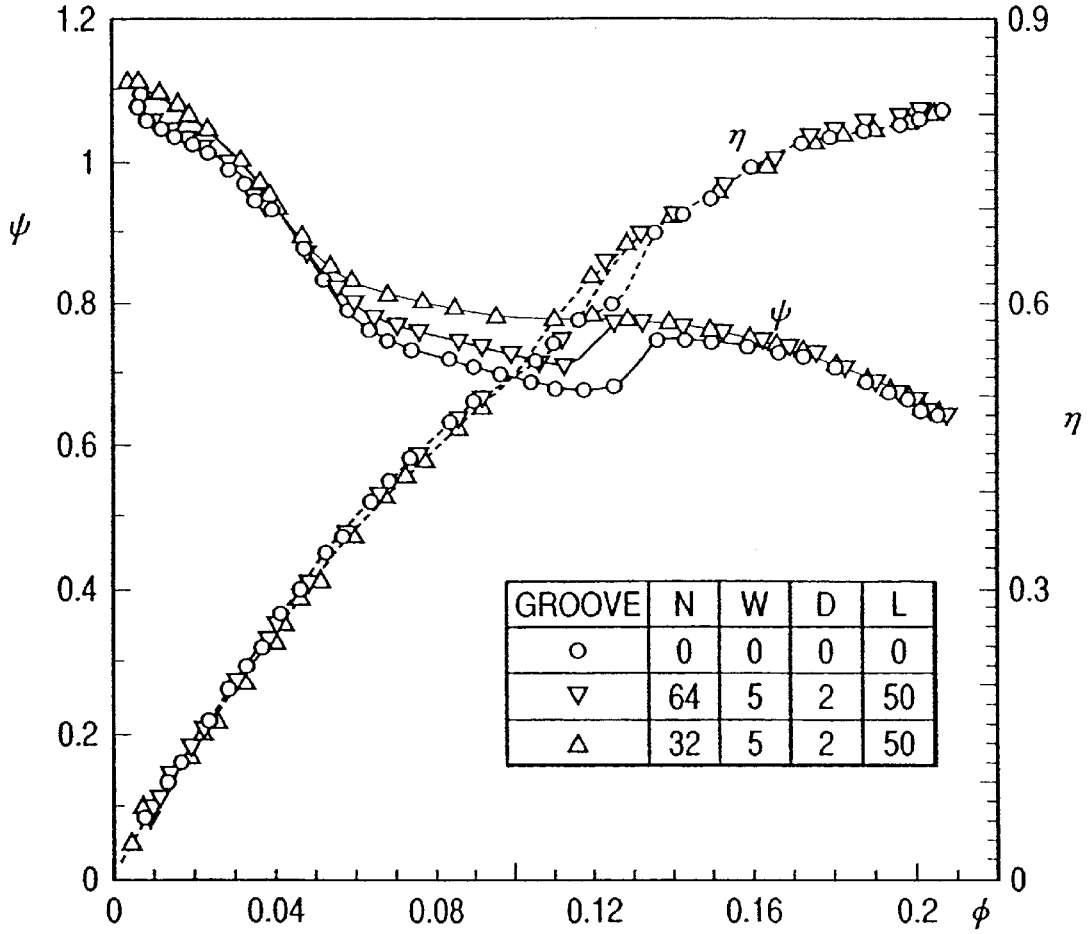
FIG. 5 is an explanatory view of effects of the present invention (a part 4)

FIG. 5 is an explanatory view for showing further other effect of the present invention (a part 4), in particular, also for showing influences of the depth and the width of the grooves.

Namely, it is indicated that, if the grooves are kept to be same in the configuration or profile thereof, the more the number of pieces of the grooves, the better the characteristic curve of the head-flow rate, i.e., the behavior of uprising at the right-hand side is improved.

From the above, the following aspects can be listed up, to be considered when designing the grooves:

1. The position "a" of the groove at the terminal position at downstream side, though it should not be restricted in a specific position thereof, in particular, as far as it lies in a position where the fluid can be extracted therefrom, being under such the pressure that it can suppress generation of the swirl due to the recirculation occurring at the terminal position "b" at the upper stream side of the grooves by injecting thereof, however it must be selected in appropriate at the location, because the efficiency of the turbo machine is decreased down if it is located at the position of high pressure being higher than that of the necessity.
2. There is no need to deepen the depth of the grooves, however it is rather effective to form a large number of the grooves which are wide in the width as far as possible.

Further, in accordance with various experiments made by the inventors of the present innovation, it is acknowledged that the width (W) of the above-mentioned grooves and the number (N) of them are preferably selected in a range approximately from 30% to 50% of a total circumference length of the casing in which the above grooves are formed (i.e., $\pi \times D$; where D=diameter in a portion of the casing where the above grooves are formed). Also, the depth (d) of them is preferable to be approximately from 2 mm to 4 mm in the above embodiment where the diameter (D) of the casing is approximately 250 mm, and from this is appear that the ratio of the depth (d) of the grooves with respect to the diameter of the casing should be set within a range approximately from 0.5% to 1.6% (d/D=0.5%–1.6%).

Next, detailed explanation will be given on a second embodiment of the present invention. In the turbo machine according to the second embodiment of the present invention, there are provided flow passages or channels for connecting between a spot at the inlet of the impeller where the recirculation occurs when the flow rate is low and an area on the flow surface of the casing in which the blades of the impeller reside in a gradient direction of fluid pressure, for the purpose of suppressing the swirl due to the recirculation at the inlet of the impeller, as well as the rotating stall thereof.

With such the construction, in the flow passages, connecting between a downstream side terminal position within the area in which the blades reside on the flow surface of the casing and an upper stream side terminal position where the recirculation occurs when the flow rate is low, fluid flows into the reverse direction from the downstream side terminal position back to the upper stream side terminal position, so as to be injected into the spot where the recirculation occurs when the flow rate is low. Accordingly, a portion of the fluid being upraised in pressure by itself flows into the reverse direction in the flow passages which are formed on the casing to be injected into the spot where the recirculation occurs, thereby suppressing generation of the swirl due to the forward component (i.e., a component in parallel to the main inlet flow) of the recirculation at the impeller inlet. Therefore, it is possible to remove the behavior uprising at the right-hand side in the head-flow rate characteristic curve of the turbo machine.

However, in a case where it is constructed as mentioned in the above, machining process of the grooves is difficult as will be mentioned below. Namely, the grooves are provided in the direction of main gradient of fluid pressure and the easiest configuration or shape thereof is in a straight line-like, with aligning a central line of the groove in the axial direction, however the grooves are provided on the inner wall (i.e., the flow surface) of the casing at the side opposing to the impeller, and are formed in the condition of being sunken from the casing wall. When trying to machine such the grooves with a tool, since the edges of the grooves at the both ends (i.e., upper and lower stream sides) are the dead ends in the shape, the tool must be stopped at the ends when processing cutting with shifting the tool along the central line of the groove. Therefore, there can be considered defects that an efficiency of machining is decreased down extremely, that it takes much time for the machining, and that it brings about an increase of manufacturing cost thereof.

For improving in those aspects, according to the present invention, the following are proposed:

(1) The bottom surface of the groove is made fit to the height of the surface of the casing inner wall (i.e., the flow surface), so that there will occurs no problem even if the tool exceeds over the end of the groove during the machining process of the grooves. The blade is made in a step-like shape, in which the height of blade differs corresponding to the heights of the grooves from the portion opposing to the grooves to that not opposing to the grooves, so as to be corresponding to convex portion of the grooves.

(2) The casing portion in which the grooves are formed is separated from other portion(s) thereof. Namely, by making it into separated structure, it is possible to machine the grooves with ease.

Further, for obtaining the turbo machine having the head-flow rate characteristic curve without such the behavior of uprising at the right-hand side also for the turbo machine which has a closed-type impeller having a shroud thereabouts, the following is proposed.

Namely, the shroud is removed only at the blade portion where the recirculation occurs in the inlet portion of the closed-type impeller, while it is remained in the downstream side thereof for remaining the impeller as that with the shroud thereabouts. And, the plurality of grooves are formed on a portion of the casing inner wall in the direction of pressure gradient, opposing to that portion of the impeller without the shroud thereabouts.

Hereinafter, more concrete embodiments of the present invention will be explained in more details by referring to the attached drawings.

Figure 6:
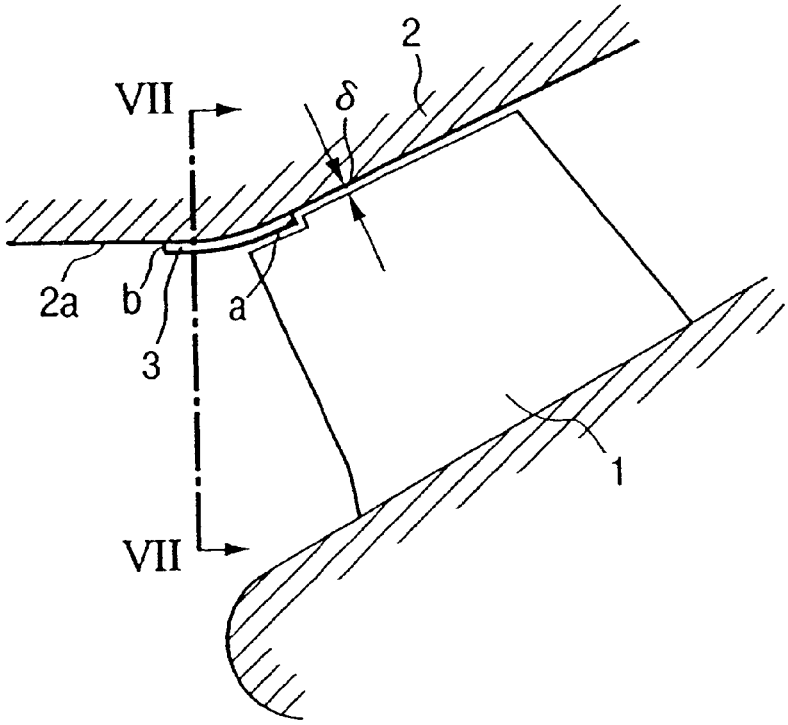
FIG. 6 is a meridian plane view of a mixed-flow pump according to a second embodiment of the present invention.
Figure 7:
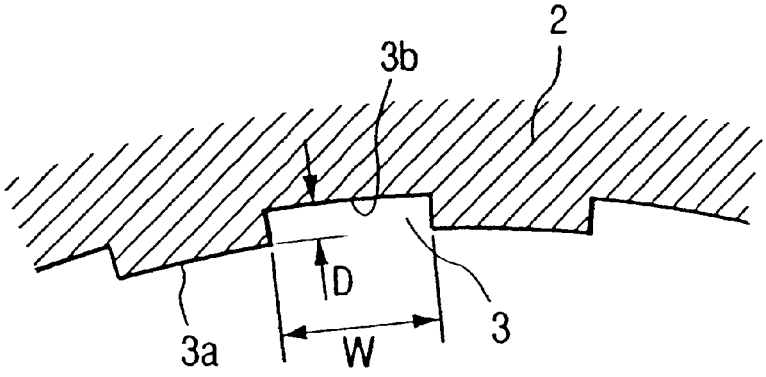
FIG. 7 is a cross-section view of a cutting line II—II in FIG. 6.

FIG. 6 shows an example of the second embodiment of the present invention. A II—II cross section view of FIG. 6 is shown in FIG. 7.

On an inner wall 2*a* (i.e., the flow surface) as the flow passage of the casing 2 including an open-type impeller therein, in particular in a mixed-flow pump, are formed the grooves in the axial direction thereof. The groove is constructed with a convex portion 3*a* of height D projecting from the inner wall 2*a* of the casing and a concave portion 3*b* at the height being equal to that of the inner wall 2*a*. The width (W) and the number (N) are, for example, approximately D/W=0.05–0.3, N=25–100, respectively. In the pump from 300 mm to 4,500 mm in the diameter of the impeller, the width (W) is, for example, approximately from 5 mm to 150 mm, in more preferable from 8 mm to 30 mm, and the height (depth) of the grooves is from approximately 0.1 times to 0.3 times of the width of the grooves corresponding thereto, for example, approximately from 0.5 mm to 30 mm, in more preferable from 1.5 mm to 6 mm. On a while, the blade of the impeller is made in such a form that, in height thereof, a distance $\delta$ at the blade tip for the normal open-type impeller can be maintained, in particular in the configuration on the meridian plane including the convex portion of the grooves at a static side.

When the pump is operated in the low flow rate region with such the construction, the fluid increased up in pressure by the blades flows backward in the groove 3, directing from the terminal position a at the downstream side to the terminal position b at the upper stream side, and is injected into the spot of the recirculation occurring when the flow rate is low, thereby preventing from generation of the swirl due to the forward component of the recirculation at the spot where the recirculation occurs. As the result of this, the head-capacity characteristic curve is resolved from the portion uprising at the right-hand side therein, thereby becoming a stable curve without the behavior uprising at the right-hand side. With such the construction mentioned above, there is an advantage that the manufacturing of the grooves can be performed easily. This is, because the convex portion 3*a*of the grooves extends from the wall surface 2*a* at the terminal of the groove and also because the concave portion 3*b* of the grooves is at the same height of the wall surface at the terminal, the tool can pass through without stopping at the end edge of the grooves in the processing of thereof, in particular in the machining process, therefore the efficiency in the machining can be improved.

Figure 8:
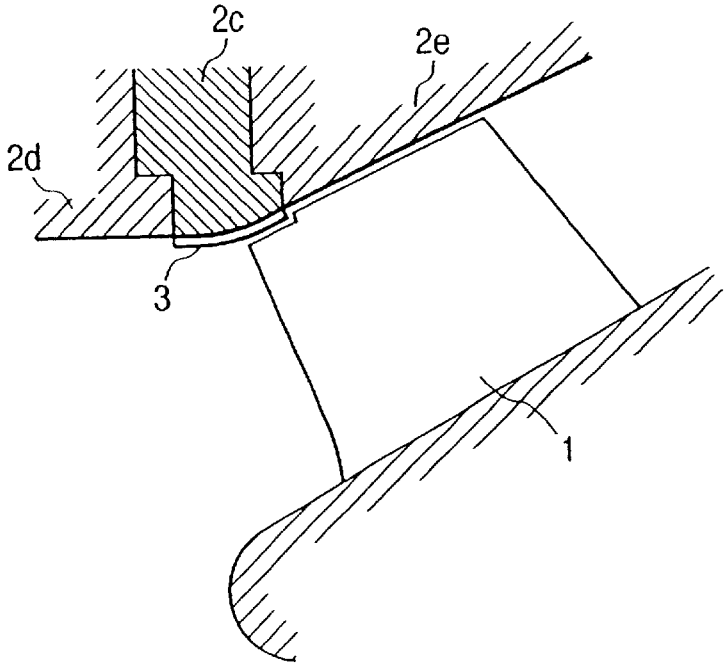
FIG. 8 is a meridian plane view of a (i.e., a first) variation of the mixed-flow pump according to the second embodiment of the present invention.

A (first) variation according to the second embodiment of the present invention is shown in FIG. 8. In this example, the casing 2 at the static side is constructed with a static side casing liner 2*c* including the grooves therein, and static side casing liners 2*d* and 2*e* without the grooves, and those static side casing liners 2*c*, 2*d* and 2*e* being made as separated elements are positioned in an axial direction thereof. With such the construction, the machining of the grooves 3 must be performed only on the casing liner to be formed with such the grooves therein, as a one part, and the end edge portion of the grooves are opened, therefore the efficiency in the machining can be improved much more.

Figure 9:
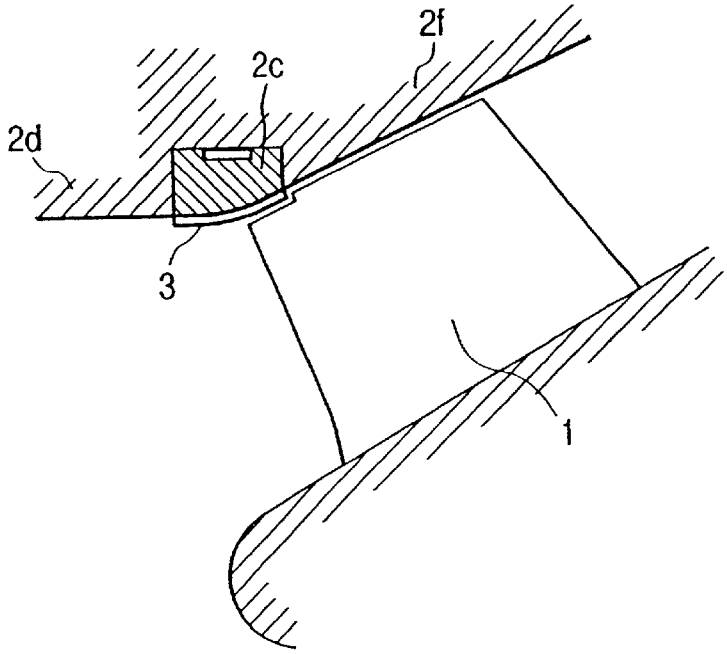
FIG. 9 is a meridian plane view of another (i.e., a second) variation of the mixed-flow pump according to the second embodiment of the present invention.

Further, another (a second) variation of the second embodiment of the present invention is shown in FIG. 9. In this example, also the casing 2 at the static side is constructed with a static side casing liner 2*c* including the grooves therein, and static side casing liners 2*d* and 2*f* without the grooves, however the stationary side casing liner 2*c* including the grooves is made as a separated element being divided from the stationary side casing liner 2*f* without the grooves in a radial direction thereof. In this example, also only the casing with the grooves can be treated as a one part in the machining of the grooves 3, and the end edge portion of the grooves are opened, therefore the efficiency in the machining can be improved much more.

Figure 10:
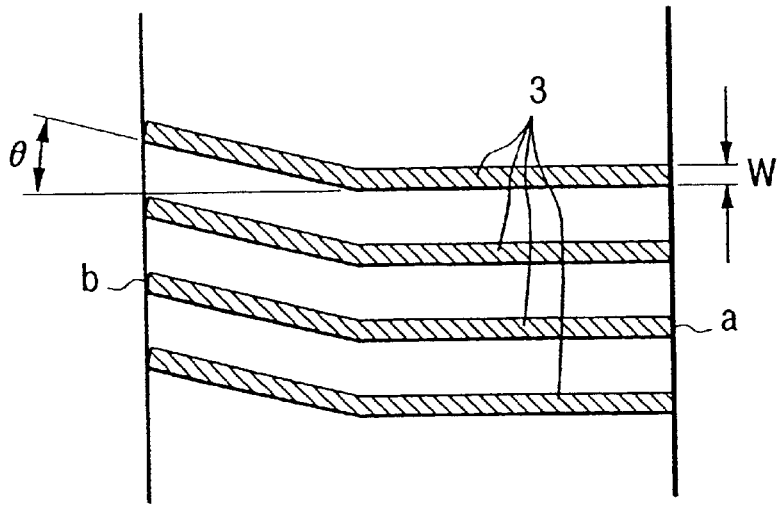
FIG. 10 is a plane view of showing an example of form of grooves in the above-mention second embodiment according to the present invention.

An example of the configuration of the grooves according to the second embodiment of the present invention is shown in FIG. 10. In this example, a starting end of the groove 3 located at the upper stream side of the impeller 1 is inclined only by an angle θ in the rotating direction of the impeller from a direction of the pump axis. With such the construction, in the region of low flow rate where the instability occurs in the head-capacity characteristic curve, the recirculation, i.e., the reverse flow from the impeller at the upper stream side is suppressed by the grooves 3, in particular a circulating component thereof, therefore the swirl component in the main flow which flows into the impeller is reduced. Accordingly, the head-capacity characteristic curve which the impeller can outputs theoretically is not decreased down, then a stable head-capacity characteristic curve can be obtained thererom. However, at the flow rate in the vicinity of the closure point, the reverse flow of the recirculation reaches further to a side in the stream upper than the recirculation area mentioned above. However, the direction of the grooves at that location is, not in the direction of the pump axis, but is inclined by the angle θ into the rotation direction of the impeller. Accordingly, to the reverse flow reaching to the vicinity of the starting end of the grooves is given a swirl component in the direction of the grooves, i.e., in the rotating direction of the impeller, and by that reverse flow, the swirl component is also given to the fluid flowing into the impeller by a little bit. Therefore, the head-capacity characteristic curve which the impeller can output theoretically falls down comparing to the case where the grooves are formed in parallel to the pump axis, and following therewith, an axial motive power consumed for rotating the impeller also falls down, thereby obtaining reduction in an axial motive power for closure. In this manner, with such the configuration of the grooves as shown in FIG. 10, it is possible to obtain, not only the stability of the head-capacity characteristic curve, but also the reduction in the axis motive power for closure, thereby obtaining the mixed-flow pump having a superior characteristics therewith.

Figure 11:
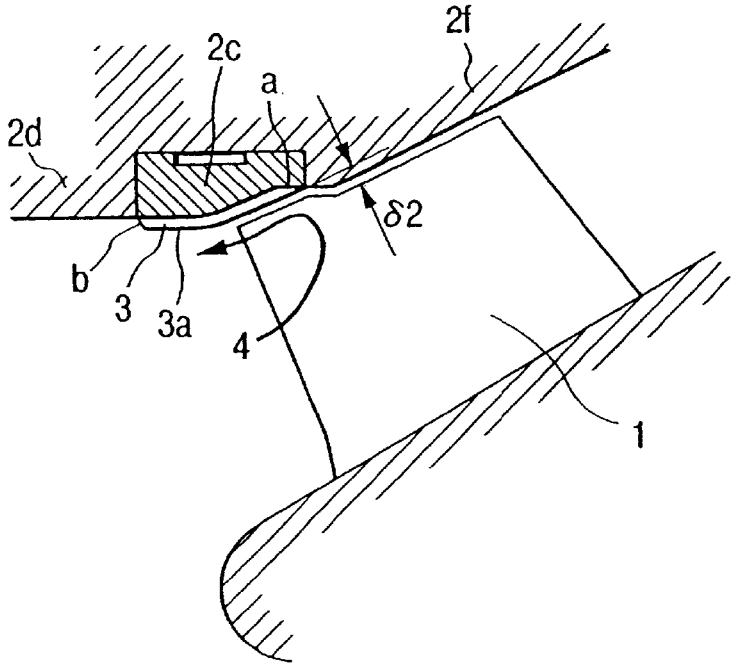
FIG. 11 is a meridian plane view of further other (i.e., a third) variation of the mixed-flow pump according to the second embodiment of the present invention.

A further other (a third) variation according to the second embodiment of the present invention is shown in FIG. 11. In this example, comparing to those examples mentioned in the above, there are further treated with the following improvements. Namely, in the configuration on the meridian surface thereof, the convex portion 3*a*of the groove 3 is made larger than the configuration of the flow passage of the stationary side casing liner 2*f* without the groove being extended into a suction side as it is, in the distance of the radial direction from the rotation center of the pump. On a while, the configuration of the tip of the impeller (i.e., the shape at the shroud side) opposing to the portion of the grooves is so determined that there are defined appropriate apertures or spaces between the grooves 3 on the stationary side casing liner 2*c* and between the stationary side casing liner 2*f*, respectively. Namely, in the flow passage on the meridian plane, each the blade of the impeller is constructed so that the height of there of at the downstream side is lower than that at the upstream side by 52 in the vicinity of the terminal a of the groove. When the turbo machine is operated with such the structure in the region of low flow rate, there can be obtained the following advantages. In the region of low flow rate where the instability appears in the head-capacity characteristic curve if no groove is formed, there occurs the recirculation 4 in the flow, as shown in FIG. 11. In this instance, because of the existence of the step-like portion δ2 mentioned above, the recirculation 4 is interrupted by that step-like portion at the tip side of the blade, thereby being prevented from entering into the lower flow side. Accordingly, in such the pump mentioned above, since the reverse flow begins from big flow amount, the failing down in the unstable portion in the head-capacity characteristic curve comes to be small in the degree thereof, thereby the stabilization of the head-capacity characteristic curve can be realized more remarkably. Namely, the instability of the head-capacity characteristic curve can be lessened even in the case where the grooves 3 are not formed, as well as in the case where the grooves 3 are provided, and the instability of the head-capacity characteristic curve (i.e., the behavior of uprising at the right-hand side in the head-capacity characteristic curve) can be removed with certainty. Further, the convex portion 3*a* defining the starting end b of the groove 3 is formed in an inclined direction. And, this starting end 2*b* is provided in the vicinity of the portion where the flow passage is wound from the portion in parallel with the axis of the casing 2 into the direction of the external diameter thereof.

Next, explanation will be given on a third embodiment, in which the present invention is applied into the closed-type mixed-flow pump.

Figure 12:
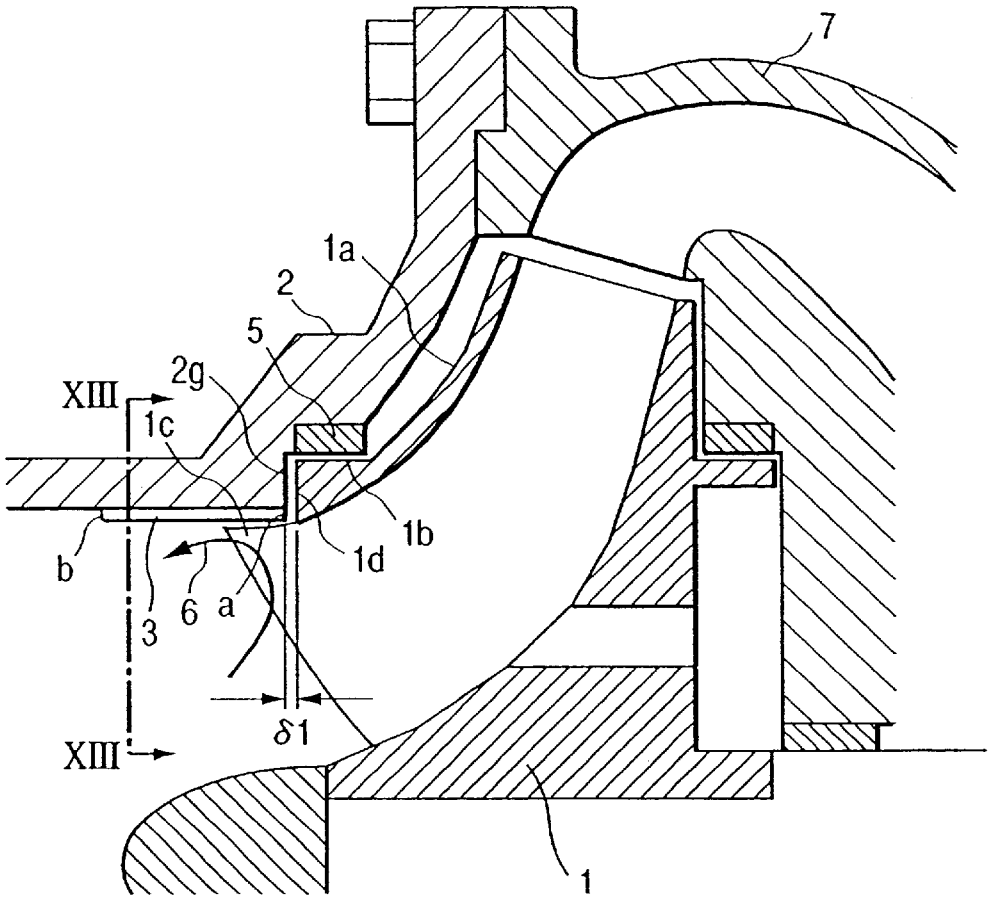
FIG. 12 is a meridian plane view of a closed-type mixed-flow pump according to a third embodiment, into which the present invention is applied.
Figure 13:
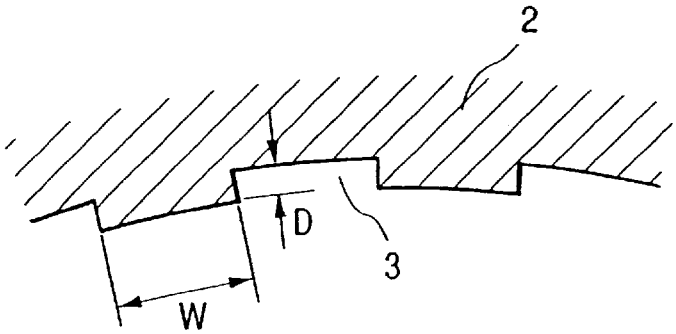
FIG. 13 is a cross-section view in accordance with a cutting line VIII—VIII in FIG. 12.

FIG. 12 shows an example according to the present invention, and FIG. 13 shows a VIII—VIII cross section view of FIG. 12.

On the closed-type impeller 1 of the mixed-flow pump, there is provided a shroud 1*a* thereabouts. This shroud 1*a* is not provided in the vicinity of the inlet 1*c* of the impeller, therefore the impeller is made as an impeller of a semi-open type having the shroud in a part. At the most inner diameter of the shroud is provided a mouth ring portion 1*b* , and on an inner surface of the casing as the stationary side is provided a casing ring 5. A sealing portion of the rotation axis 3 is defined between those mouth ring portion 1*b* and the casing ring 5. On the inner wall (i.e., the flow surface) 2*a* of the casing at the stationary side opposing to the blades at the portion where no shroud is provided thereabouts, as shown in FIG. 13, a plurality of the grooves 3 are formed aligning at the same distance in the axial direction thereof. The terminal a at the downstream side of the groove resides at a position entering into the downstream side from a front edge of the blade a little bit (i.e., the position being adjacent to the mouth ring portion in the vicinity of the inlet 1*c* of the impeller),while the terminal position b thereof at the upstream side resides at the side in stream being upper than the blades of the impeller. A portion 2*g* of the casing 2 opposing to an end surface 1*d* of the shroud of g the impeller is provided at the position being same to the downstream side terminal position a of the groove 3 in the axial direction thereof. The surface 2*g* of the casing 2 in a direction being orthogonal to the axis thereof and the end surface 1*d* of the shroud are positioned with the aperture 81 in the axial direction therebetween.

When the pump is operated with such the structure in the region of low flow rate, as shown in FIG. 12, there occurs the recirculation, i.e., the reverse flow. A portion of the flow 6 flows in the backward direction within the grooves 4 from the downstream side terminal position a up to the upstream side terminal position b thereof, however since the grooves are formed in the axial direction of the pump, the reverse flow flowing in the grooves has no component rotating in the rotation direction of the impeller. Accordingly, that reverse flow flowing within the grooves toward the upstream side is injected into the spot where the recirculation 6 occurs in the low flow rate, thereby enabling to suppress generation of the swirl due to the forward component of the recirculation at the inlet of the impeller, as well as the generation of the rotating stall thereof. Namely, the swirl component in the fluid of the recirculation flowing backward the upstream is weaken by the flow injected from the grooves, and the swirl in the fluid flowing into the impeller comes to be small. Therefore, the decrease in the theoretical head is made small, thereby obtaining the stability in the head-capacity characteristic curve.

In this manner, with the present embodiment, since it is possible to suppress the swirl in the fluid flowing into the impeller by means of small amount of the fluid flowing through the groove 3, the head which can be outputted theoretically by the impeller is increased up, and the head-capacity characteristic curve can be resolved from the unstable portion, thereby obtaining the stability thereof. With the present embodiment, also with the closed-type impeller having the shroud thereabouts, it is possible to obtain the stability of the head-capacity characteristic curve with the provision of the grooves 3 in the casing 2, i.e., the head-capacity characteristic curve shows the behavior continuously falling down at the right-hand side, and therefore it is possible to obtain a pump characteristic being stable.

Figure 14:
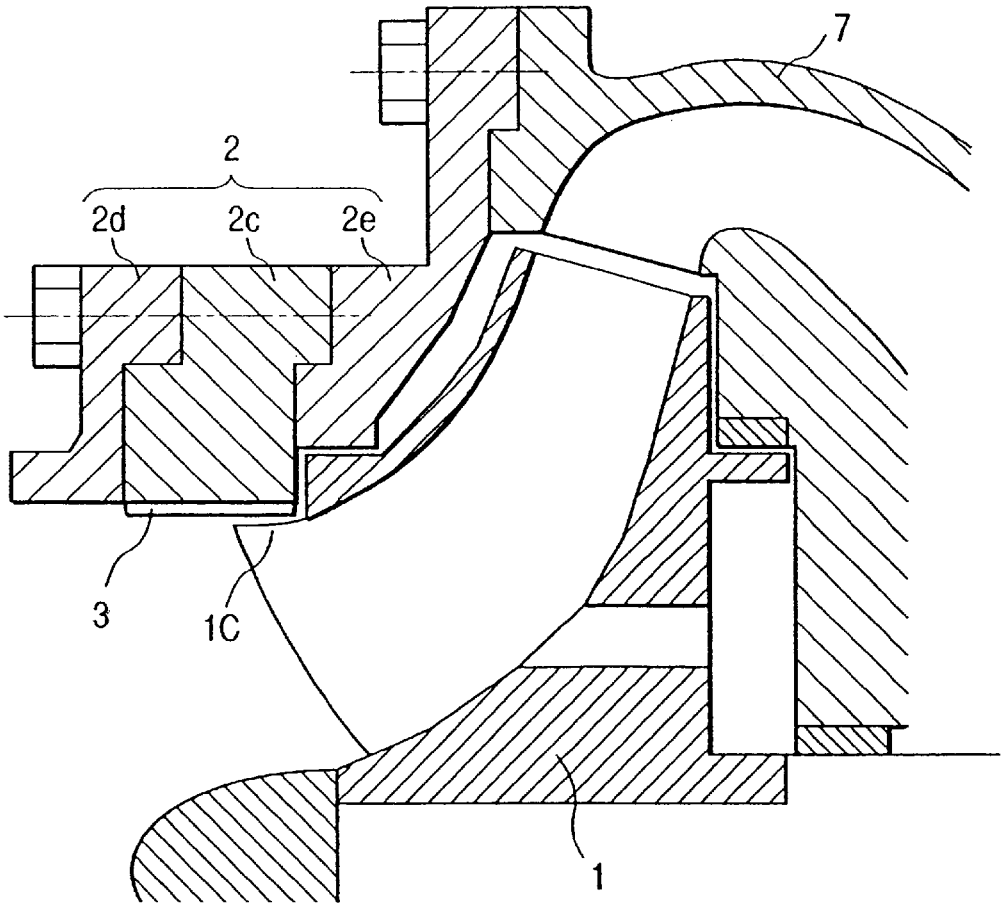
FIG. 14 is a meridian plane view of the closed-type mixed-flow pump as a (i.e., a first) variation of the third embodiment of the present invention.

FIG. 14 shows a (first) variation of the third embodiment according to the present invention. The casing 2 is constructed with the casing liners 2*c*, 2*d* and 2*e* which are divided in the axial direction thereof, and the grooves 3 are formed in the casing liner 2*c* which is provided at the inlet portion of the impeller. The grooves 3 are formed in the configuration being same to those in the respective examples mentioned in the above. According to this example, since grooves 3 are opened at both ends thereof, it is also possible to machine the grooves 3 by means of the tool with ease.

Figure 15:
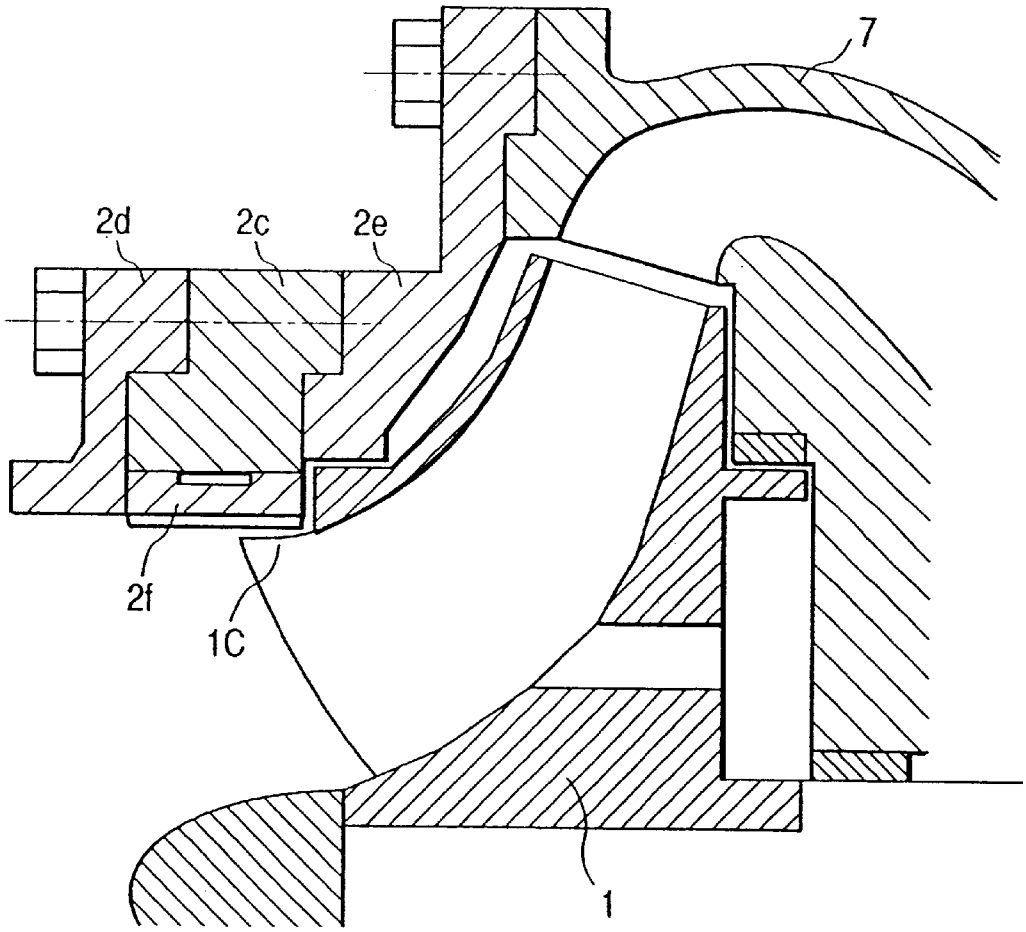
FIG. 15 is a meridian plane view of the closed-type mixed-flow pump as another (i.e., a second) variation of the third embodiment of the present invention.
Figure 16:
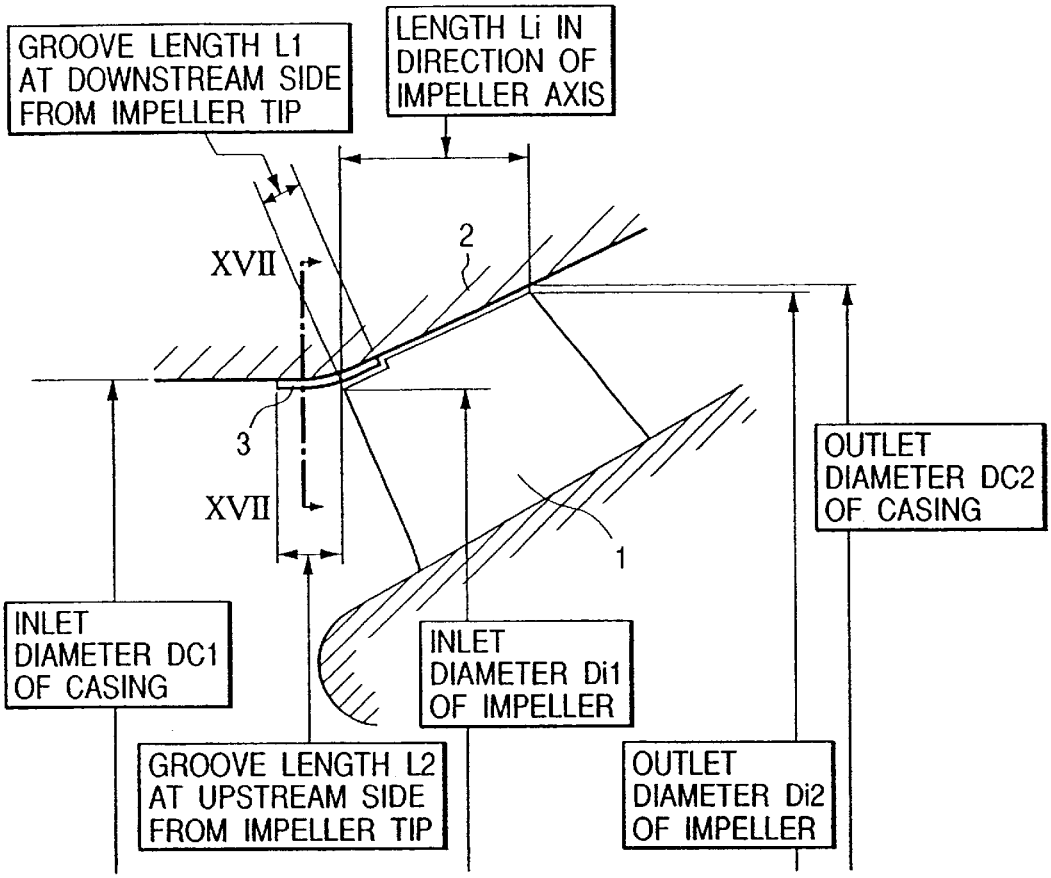
FIG. 16 is a meridian plane view of explaining an index JE No. for determining the configuration of grooves, according to the present invention.

FIG. 15 shows another (second) variation of the third embodiment according to the present invention. The casing 2 is constructed with the casing liners 2*c*, 2*d*, 2*e* and 2*f* which are divided in the axial direction thereof, and further the casing liners 2*c* and 2*f* are divided into the radial direction thereof. The grooves 3 are formed in the casing liner 2*f* at the inner diameter side, which is provided at the inlet portion of the impeller. Also in this example, the grooves 3 are formed in the configuration being same to those in the respective examples mentioned in the above. According to this example, since the casing liner 2*f* in which the grooves 3 are formed can be made smaller than the part 2*c* shown in FIG. 14, therefore it is possible to machine the grooves 3 by means of the tool with much ease.

Although the explanation was given on the closed-type mixed-flow pump in the embodiments mentioned above, the present invention also can be applied to other turbo machines, such as a centrifugal pump, a mixed-flow air blower, a mixed-flow compressor, etc., each having the open-type impeller or the closed-type impeller.

Next, a preferable configuration of the grooves 3 in the respective examples will be explained by referring to FIGS. 16 to 19.

From various results of experiments, the configuration of the grooves 3 are studied, being preferable for removing the behavior of uprising at the right-hand side, in particular in the head-flow rate characteristic of the turbo machine, as well as for suppressing the decrease in the efficiency thereof, and there can be found the following index (hereinafter, being called by "JE No.") relating to an appropriate configuration of those grooves.

The JE No. can be defined by the following equation:

$$JE\ \text{No.} = WR \times VR \times WDR \times DLDR$$

where, WR is a width ratio, being a value obtained by dividing a total value of the groove widths W by a periphery length of the casing. Namely, "WR=(number of the grooves N×groove width W)/(an averaged periphery length of the casing at the portion on which the grooves are formed)", and the averaged periphery length of the casing can be obtained, by referring to FIG. 16, for example, by "π×(an inlet diameter of the casing Dc1+an outlet diameter of the casing Dc2/2".

The VR is a volume ratio, being a value obtained by dividing a total volume of the grooves by a volume of the impeller. Namely, it means "VR=total volume of the grooves/volume of the impeller". Here, the total volume of the grooves can be obtained by "number of the grooves N×grooves length L×groove width W×groove depth D", while the volume of the impeller by "inlet area of the impeller×axial direction length at the tip of the impeller Li". The inlet area of the impeller can be obtained from an inlet diameter Di1 of the impeller. The grooves length L is "L1+L2" in the FIG. 16.

The WDR is a width-depth ratio, and can be obtained by "WDR=groove width W/groove depth D".

Figure 17:
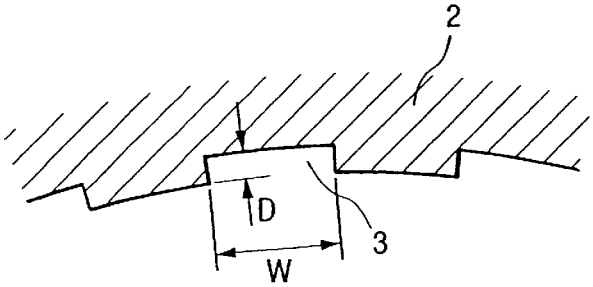
FIG. 17 is a cross-section view in accordance with a cutting line XII—XII in FIG. 16.

The DLDR is a ratio between a length of the groove and the depth thereof, in the flow are being lower than the impeller inlet, and it is "DLDR=groove length L1 at the side lower than impeller chip L1/groove depth D", by referring to the FIG. 17.

Figure 18:
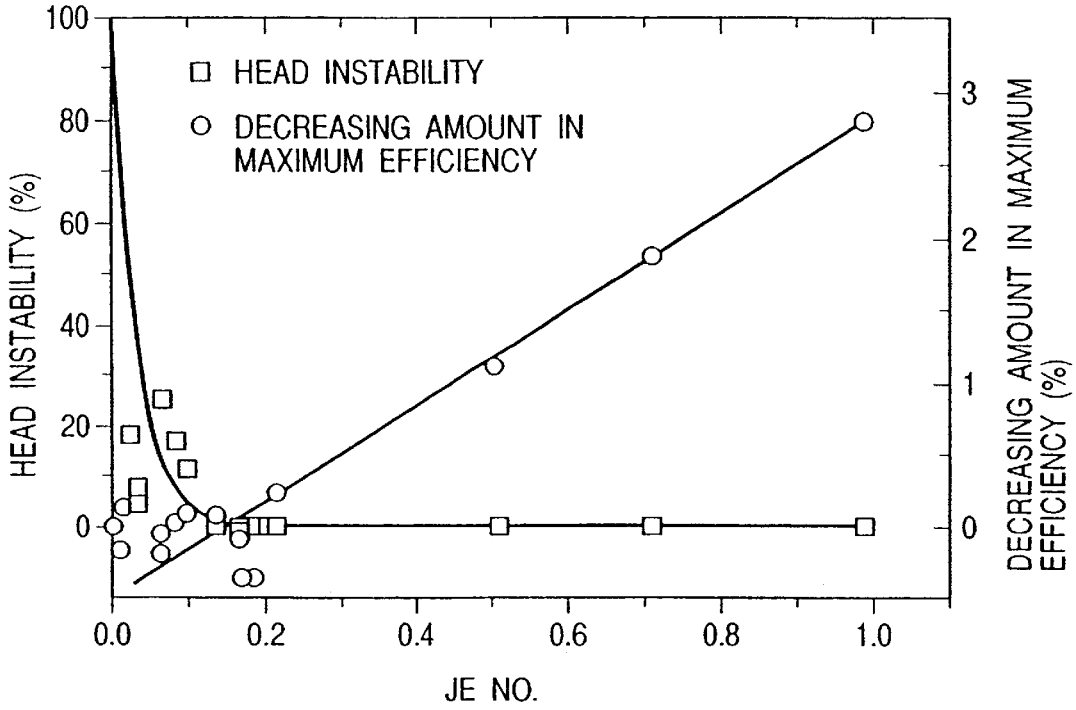
FIG. 18 is a graph of explaining relationships of the index JE No. for determining the configuration of grooves in the embodiments mentioned above, with respect to a head instability and a decreasing amount in the maximum efficiency.

FIG. 18 shows the experimental results by applying the above JE No. In the figure, a horizontal axis indicates the JE No. An vertical axis at the left-hand side indicates the instability of head (%), and it is defined by the following equation, which indicates an amount decreased at the unstable portion of the head-flow rate characteristic curve, being represented by a ratio between the decreasing amount $\Delta\psi_0$ when no groove is formed and the decreasing amount $\Delta\psi$ when the grooves are formed.

Head instability (%)=$(\Delta\psi/\Delta\psi_0)\times 100$

Figure 19:
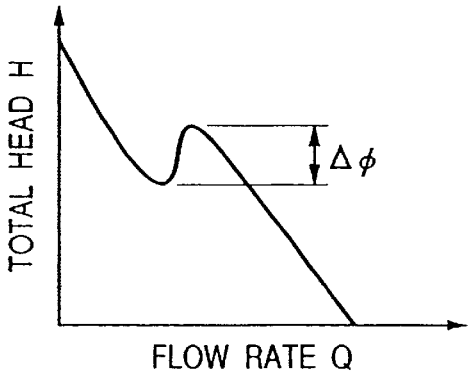
FIG. 19 is a graph of showing a flow rate-head characteristic curve of the turbo machine of the above-mentioned embodiments according to the present invention.

However, each of the decreasing amounts $\Delta\psi$ and $\Delta\psi_0$ is obtained, as shown in FIG. 19, from a difference between the maximum value and the minimum value in the unstable portion (i.e., the portion showing the behavior of uprising at the right-hand side) of the head-flow rate characteristic curve. The $\Delta\psi$ is an finite value when there is the instability in the head (i.e., when it shows the behavior uprising at the right-hand side), on the other hand it is zero (0) when there is no such the instability in the head (i.e., when it does not shows such the behavior uprising at the right-hand side). Accordingly, it means that, the unstable portion of the head-flow rate characteristic curve is distinguished completely due to the function of the grooves when the head instability is at 0%, while that no effect can be obtained from the grooves and then no improvement can be achieved in the instability at all when the head instability is at 100%. Further, when the head instability lies between 0% and 100%, it means that, through the instability of the head is not extinguished completely, but the unstable portion is improved by the grooves to a certain degree.

A vertical axis at the right-hand side in FIG. 18 indicates the decreasing amount (%) of the maximum efficiency, and it means the difference in the maximum efficiency (%) between when the grooves are provided in the same pump and when no groove is provided therein. Namely, it is 0% if no change occurs in the maximum efficiency of the pump between before and after the provision of grooves, and it has a plus value when the decrease occurs in the efficiency by the provision of the grooves, for example, 3% means that the decrease of 3% occurs in the efficiency with the provision of the grooves.

By referring to FIG. 18 on the basis of the explanation given in the above, the head instability exceeds 80% in the characteristic curve thereof when the JE No. come to be equal or smaller than 0.03, then the effect of the grooves becomes small abruptly. When the JE No. is in the vicinity of 0.03, the head instability is improved to be approximately 30%, and when it exceeds 0.03, the head instability is further improved. Then, the instability is 0% when the JE No. is 0.15, more or less, i.e., it can be seen that the instability is dissolved. When the JE No. exceeds 0.15, the head instability is stable as it is at 0%. From this fact, in view point of obtaining the stability in the head, the JE No. should be made equal or greater than 0.03, preferably. Further, from the view point of the efficiency in FIG. 18, the decreasing amount in the maximum efficiency is 0% or less than that until the JE No. comes up to be 0.15, or more or less, however if it exceeds 0.15, the decreasing amount of the maximum efficiency becomes large in proportion to that JE No. Assuming that an acceptable amount of decrease in the efficiency due to the provision of the grooves be up to 1%, the JE No. is preferable to be equal or less than 0.5. Accordingly, from view points of both the head stability and the efficiency, it is preferable to set an appropriate range from 0.03 to 0.5 for the JE No., and it is most suitable that the JE No. is selected to be from 0.15 to 0.2, as a condition for dissolving the instability completely but without decrease in the efficiency.

Further, the experimental results shown in FIG. 18 are for the pump at 830 of the specific velocity thereof, for example, however similar results can be obtained also in the case where the same experiments are made on the mixed-flow pumps of the specific velocity of 1,250 and 1,400. Therefore, it can be ascertained that the configuration of the grooves can be determined by using the JE No. being as the above-mentioned index, at least in the range from 800 up to 1,400 in the specific velocity. Further, it can be considered that the configuration of the grooves also can be determined by using the JE No. for those being from 300 up to 2,000 in the specific velocity thereof.

According to the present invention, a portion of fluid being increased in pressure by itself flows backward in a flow passage formed in the casing to be injected into the spot where the recirculation occurs, i.e., the flow without the swirl from the grooves suppresses the swirl component in the reverse flow being turned back from the impeller and forming the recirculation, therefore no swirl is generated in the fluid flowing into the impeller, thereby suppressing the generation of the swirl due to the recirculation at the inlet of the impeller, as well as suppressing the rotating stall thereof, then it is possible to remove the behavior uprising at the right-hand side in the head-flow rate characteristic curve of the turbo machine.

And, according to the present invention, with the divided structure of the casing and with the provision of the grooves on the casing liner corresponding to the inlet portion of the impeller, there can be obtain an effect that the turbo machine can be realized, wit which the machining of those grooves can be treated with ease, with almost no decrease in the efficiency, and being stable in the head-capacity characteristic curve.

Further, according to the present invention, also for the turbo machine having the closed-type impeller with the shroud thereabouts, by making the impeller as the semi-open structure without the shroud at the portion in vicinity of the inlet thereof and with provision of the grooves on the inner wall surface (i.e., the flow surface) of the casing in the direction of pressure gradient, corresponding to the portion of the impeller, thereby it is possible to realize the turbo machine with ease, being stable in the head-capacity characteristic curve even in operating at the low flow rate where the recirculation occurs, as well as, bring about almost no decrease in the efficiency of the turbo machine.

Furthermore, determining the configuration of the grooves by use of the index, i.e., the JE No., there also can be obtained an effect that the configuration being most suitable for the stability of the head-capacity characteristic curve can be obtained with ease.

Figure 20:
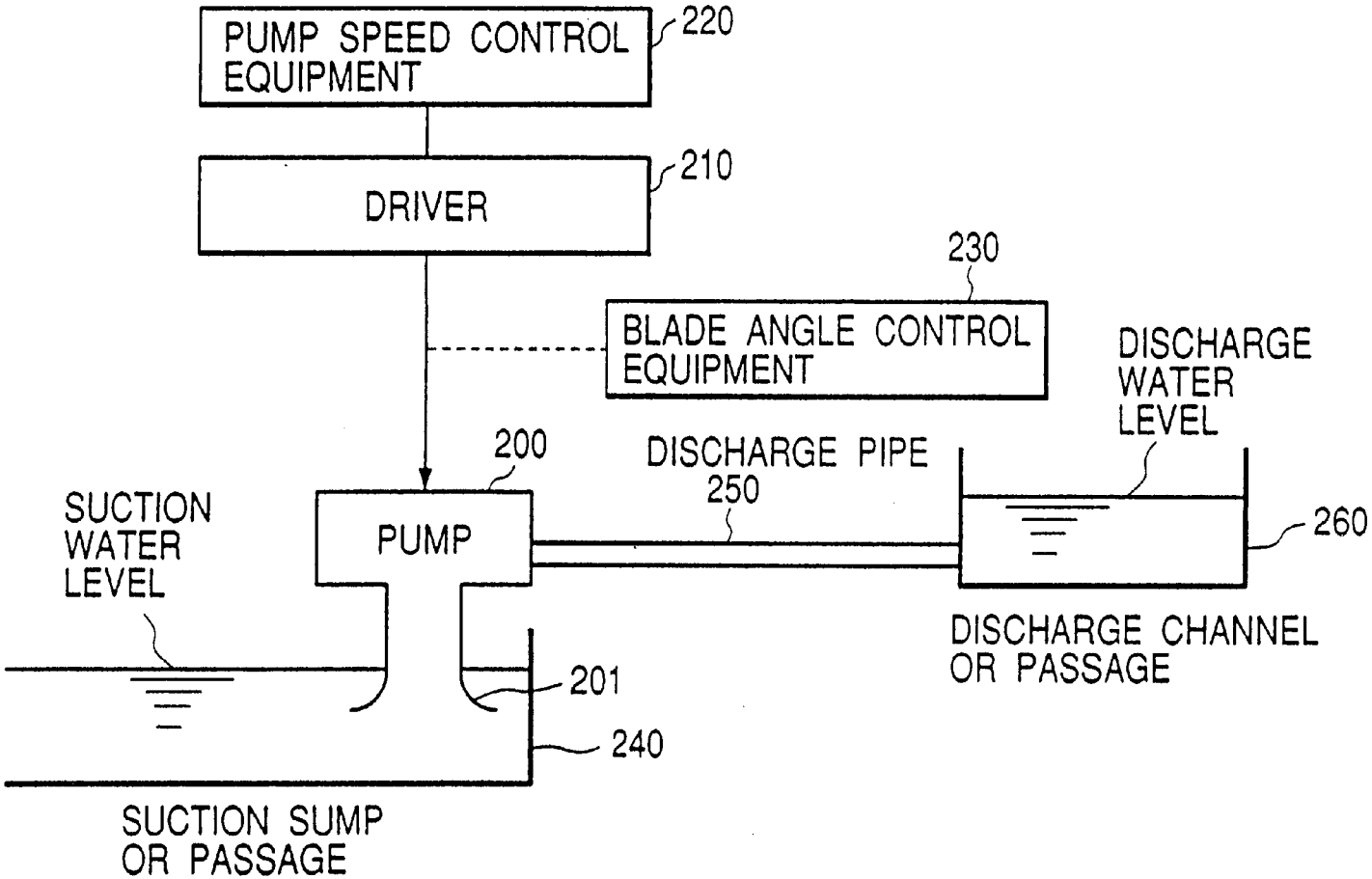
FIG. 20 is a block diagram of showing an outline of a pump station into which is applied the turbo machine according to the present invention.

Moreover, in an attached FIG. 20 is shown a block diagram of a pump station in which the present invention is applied to, however, such as a drainage pump for example, in a drainage pump station, other than the water circulating pumps in a thermal power plant or in a nuclear power plant as mentioned above.

Namely, the pump station includes a pump 200, such as the mixed-flow pump in which the shallow grooves are formed in the casing corresponding to the impeller, in particular in the portion at the inlet portion thereof. The impeller of the pump is ratably driven with an rotating axis thereof by means of a driver apparatus (or driver) 210, comprising such as a diesel engine, a gas turbine, an electric motor, etc., for example.

The rotating velocity or speed of the driver apparatus 210 is controlled by a pump speed control equipment 220, being constructed with an electric circuitry or a micro-computer unit for that purpose, for example. And, as is connected with a broken line, a blade angle control equipment 230 is further provided, if necessary, for controlling an inclination angle of the blades of the impeller depending upon the change in flow rate of the fluid flowing into the impeller.

The pump 200, having such the structure mentioned in the above, has a bell mouth 201 dipping into water in a suction sump or passage 240 and a discharge pipe or conduit 250 connected to a discharge sump or passage 260 being distant from the suction sump or passage. And, by the operation of the pump station mentioned above, the water head, i.e., the suction water level is increased or lifted up to the discharge water level in the discharge sump or passage 260, including the flow resistance within the flow passage of the fluid, i.e., in the discharge pipe 250.

In general, in the pump being designed by considering upon the efficiency primarily, assuming that the maximum flow rate is at 100%, there is a tendency that the behavior uprising at the right-hand side appears remarkably in a part of the head-capacity characteristic curve thereof, in particular from 50% to 70% in the flow rate thereof, thereby bringing the operation of the pump into unstable condition, or alternatively that, though not bringing about such the behavior uprising at the right-hand side remarkably, but the head-capacity characteristic curve comes to be flat in a portion thereof, also in the region from 50% to 70% of the flow rate thereof.

Namely, an operating flow rate by the pump of the pump station is determined at a point intersecting between a static head which is determined as a difference between the water heads or levels at the suction side and the discharge side in the pump station, a resistance curve which is determined by summing up resistance in the flow passage or pipes in the pump station, and the head-capacity characteristic curve of the pump. If there is a region uprising at the right-hand side in the head-capacity characteristic curve, there can be a case where the head-capacity characteristic curve intersects with the resistance curve at a plurality points. In such the instance, it is impossible to determine the crossing point at only one point, i.e., the flow rate cannot be determined uniquely, therefore the flow rate cannot be determined. In particular, it is remarkable when the stationary head is high and the pipe resistance is small.

Accordingly, in the conventional art, by bringing the maximum efficiency and the stability of the head into a balance so as to obtain the head-capacity characteristic curve without the behavior of uprising at the right-hand side, therefore there may be a case where the maximum efficiency is decreased down a little bit. Alternatively, in a case where there is the unstable region in the pump, the pump is controlled so that it is operated only in the region where no such the unstable operation occurs, by establishing an operating rule for that pump. Accordingly, in the pump station with which the operating region is controlled by the rotation speed of the pump, the rotating speed is only controllable or restricted within that region as for as being in the stable region, i.e., not entering into the unstable region. Therefore, in a case where the operation is required to enter into the unstable region in the rotation number (i.e., the rotation speed) for one unit of the pumps, such a measure is taken that the pumps are increased up in the number thereof with making the capacity for each of the pumps small, so as to shift the operation point of the each pump into a point outside the unstable region.

Also, with the a method for obtaining the stability of the head-capacity characteristic curve with the victim of the maximum efficiency to some degree, according to the conventional art, since the efficiency is decreased down a little bit due to the stable pump operation, there is a problem that consumption of electric energy comes to be larger for that. And, with the method, in which the operating points of each one of the pumps increased in the number thereof are shifted so as to escape from being in the unstable operation region, there are also problems that the facility and the control method thereof becomes complex and that the costs rises up.

Therefore, according to the present invention, there is also provided a pump station, with which the rotation speed can be altered in a wide rage, by using the mixed-flow pump, having the head-flow rate characteristic curve without such the behavior of uprising at the right-hand side and being able to achieve higher efficiency, thereby obtaining a pump station which can be operated in a wide rage of the flow rate.

Namely, the feature of the present invention lies in that, in the pump station in which the operating region of the pump is controlled by the rotation speed thereof, the pump being used in that pump station is the mixed-flow pump into which is applied any one of the casings having such the grooves as mentioned heretofore.

In the pump station mentioned above, there can be obtained effects, in particular, when a specific speed Ns is selected to be approximately from 1,000 to 1,500, assuming that the rotation speed of the mixed-flow pump which is used in that pump station is N(rpm), a total head H(m), and a discharge flow rate $Q(m^3/min)$, and that the specific speed Ns as an index of indicating the pump characteristic is obtained by an equation, $N_s=N\times Q^{0.5}/H^{0.75}$, and when a static head being determined by a suction water level and a discharge water level is equal or greater than 50% of the head at a specific point.

Further, other feature according to the present invention lies in that the rotation speed of the pump can be controlled in a control range from 60% to 100% with respect to a reference rotation speed, in a case where a driver apparatus for the pump comprises a speed reduction gear, a fluid coupling and a diesel engine. Also, the rotation speed can be controlled in the control range from 60% to 100% with respect to the reference rotation speed, in a case where the driving apparatus for the pump comprises a speed reduction gear, a fluid coupling and a gas turbine. Further, the driving apparatus for the pump comprises an electric motor which controls the rotation speed by an inverter, and in that case, the rotation speed thereof can be controlled in the control range from 0% to 100% with respect to a reference rotation speed.

Figure 21:
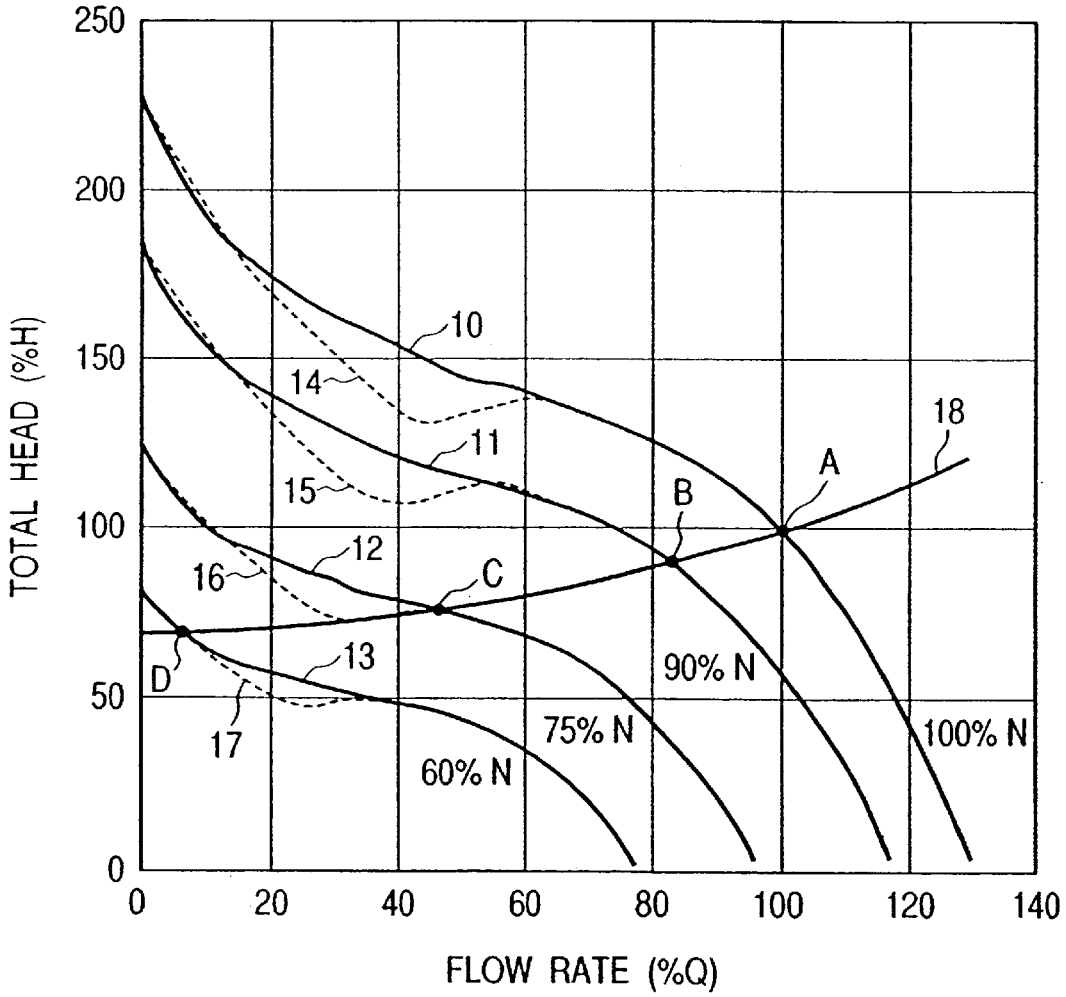
FIG. 21 is a graph of showing a head-capacity characteristic curve of a mixed-flow pump in the pump station shown in FIG. 20, for explaining effects thereof.

FIG. 21 shows an example of the head-capacity characteristic curve of the pump of that pump station, into which is applied one of the mixed-flow pumps according to the present invention mentioned in the above. In FIG. 21, the horizontal axis indicates the flow rate by the ratio of flow rate % Q assuming that a designed flow rate as a reference is at 100%, while the vertical axis a head ratio % H assuming that a designed total head as a reference is at 100%. In FIG. 21, a head curve 10 shows a characteristic of one example of the mixed-flow pump according to the present invention when the reference rotation number is 100% N, and shows a tendency of falling down at the right-hand side all over the region, therefore there is no unstable region. On the other hand, the head curve 14 shows a characteristic at 100% N in a case where the present invention is not applied to, wherein it is unstable at 50% Q, or more or less than that, and in this case, there lies the unstable region in a range from 40% Q to 70% Q. A resistance curve 18 is a characteristic of the present pump station. When the pump is operated at 100% N, the intersection point between the head curve 10 and the resistance curve 18 or between 14 and that is only one point, i.e., at a point A, therefore in either case, the pump can be operated with stability at the point A. When considering a case where the rotation number is decreased down to 90% N for the operation with reduced flow rate, according to a law of similarity which will be mentioned below, the stable head curve 10 of the pump is shifted down to a head curve 11, while the unstable head curve 14 down to a head curve 15.

The law of similarity is as follows:

$$Q2=Q1\times(N2/N1)$$

$$H2=H1\times(N2/N1)^2$$

where, Q is the flow rate, H the total head, N the rotation speed, and an appendix 1 indicates a condition of rotation speed N1 and an appendix 2 indicates a condition of rotation speed N2, respectively.

The operating point in this instance is at a point B, therefore the pump can be operated with stability irrespective of the unstable region in the head curve. When the rotation number is further decreased down to 74% N, according to the law of similarity mentioned above, the head curve 10 having no such the instability according to the present invention is shifted down to a head curve 12, wherein the intersection point between the resistance curve 18 is only one point at a point C, i.e., the operating point is at the point C. On the other hand, the head curve 14 having the instability therein is shifted down to a head curve 16 at 74% N, wherein it is almost in parallel to the resistance curve 18 in the vicinity from 30% Q to 50% Q. Therefore, the intersection point of the head curve 16 between the resistance curve cannot be determined at only one point, but there may be plural intersection points therebetween. Accordingly, the flow rate point cannot be determined uniquely, and then the operation of the pump is fluctuated in a range of the instability from 30% Q to 50% Q on that head curve to be out of control, therefore the operation cannot be performed from 30% Q to 50% Q.

When the rotation speed is further decreased down to 60% N, the head curve 10 having no such the instability according to the present invention is shifted down to a head curve 13, while the head curve 14 having the instability therein down to a head curve 17. When it is decreased down until that, the intersection point between the resistance curve 18 is determined at only one point, i.e., a point D, in either case of the head curves 13 and 17, therefore the operation of the pump is possible.

However, in the case of the characteristic curve having the instability according to the conventional art, as was mentioned previously, the pump cannot be operated in the range from 30% Q to 50% Q at the rotation speed 74% N, then the region in which the pump can be operated comes to be in discontinuity. Therefore, the pump speed is from 74% N to 100% N in the region thereof, and the operation area of the pump lies between the pint A and the point C.

On the other hand, with the mixed-flow pump according to the present invention, it can be operated with the stability at the rotation speed being equal or less than that, therefore the operation can be performed all over the wide range in flow rate from the point A to the point D.

In the present embodiment, the driver apparatus for the pump comprises the speed reduction gear, the fluid coupler, and the diesel engine, wherein the operation is possible from the point A to the point D shown in FIG. 21 when the control range in the rotation speed is from 60% to 100% with respect to the reference rotation speed. Another driver apparatus for the pump comprises the speed reduction gear, the fluid coupler, and the gas turbine, wherein the operation is also possible from the point A to the point D shown in FIG. 21 when the control range in the rotation speed is from 60% to 100% with respect to the reference rotation speed. Further, the other driver apparatus comprises the electric motor which control the rotation speed by the inverter, wherein the operation range is widen further when the control range in the rotation speed is from 0% to 100% with respect to the reference rotation speed. This is, because the rotation speed can be decreased down until a point in the vicinity of the point E in FIG. 21, the operation of the pump is possible in a range from almost 0% Q up to 100% Q.

Namely, by applying the improved pump according to the present invention into, since the efficiency hardly falls down while can be obtained the head-capacity characteristic curve being stable in the mixed-flow pump, there can be obtained the pump station, in which the range of the rotation speed can be widen much more and the operation can be realized in a wide flow rate range with ease.

Figure 23:
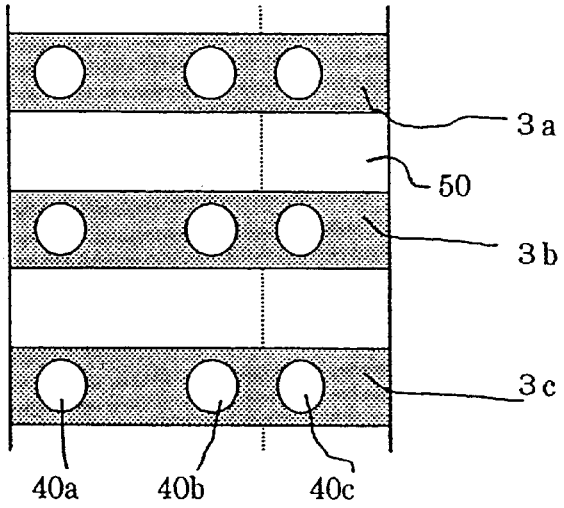
FIG. 23 is a plan view showing the grooves in the embodiment of FIG. 22.
Figure 22:
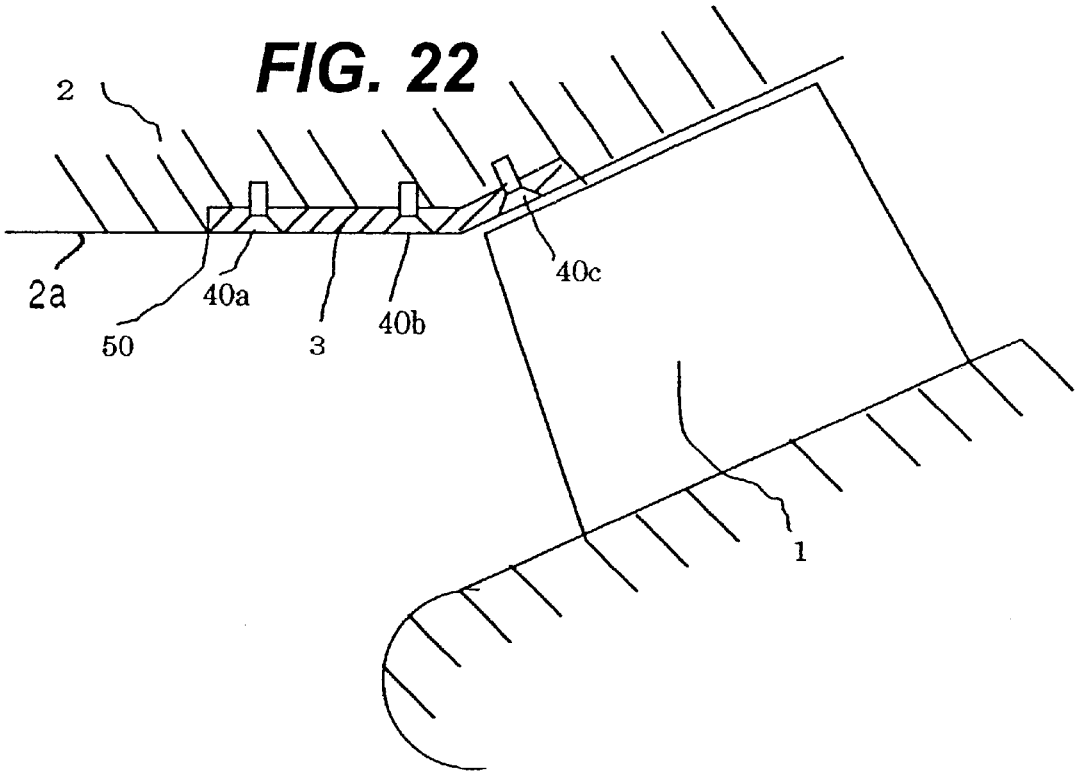
FIG. 22 is a meridian plane view of a turbo machine according to another embodiment of the present in invention.

Another embodiment of the present invention is shown in FIGS. 22 and 23. FIG. 23 is a plan view showing the grooves in the structure shown in FIG. 22.

As shown in FIG. 22, a channel 50 is provided on the inner wall 2*a* of the casing 2. The channel 50 has a relatively wide width in the circumferential or peripheral direction of the casing 2. A plurality of ribs 3 are provided in the channel 50. In this embodiment, the ribs 3 are constructed separately from the casing 2 and fixed therein as will be described hereinafter.

As can be more clearly seen in FIG. 23, a plurality of ribs 3 are provided, ribs 3*a*, 3*b* and 3*c* being shown in FIG. 23. Each of the ribs 3*a*, 3*b*, 3*c* is arranged in the channel 50 so that the ribs 3*a*, 3*b* and 3*c* have a length at least a part of which is oriented in an axial direction of the casing 2. In the embodiment shown in FIG. 23, the complete length of each of the ribs 3*a*, 3*b*, 3*c* is oriented in the axial direction of the casing 2. The ribs 3*a*, 3*b*, 3*c* are spaced from one another, in this embodiment equidistantly, to define a plurality of grooves therebetween, each of the grooves having a length at least a part of which is oriented in the axial direction of the casing 2 and a width measured in a circumferential or peripheral direction of the casing 2. In the embodiment shown in FIGS. 22 and 23, the entire length of each of the grooves is oriented in the axial direction of the casing 2.

The ribs are preferably made of rubber or other resin material for absorbing fibration.

In the embodiment shown in FIGS. 22 and 23, the ribs 3 (3*a*, 3*b*, 3*c*) are fixed in the channel 50 by screws 40*a*, 40*b*, 40*c*. Alternatively, however, the ribs 3 (3*a*, 3*b*, 3*c*) can be fixed in the channel 50 by means of an adhesive or by spot welding or projection welding.

What is claimed is:

1. A turbo machine comprising:

a casing having a flow surface defined therein;

an impeller having a plurality of blades and being positioned within said casing;

a plurality of grooves being formed in the flow surface of said casing, for connecting between an inlet side of said impeller and an area in which the blades of said impeller reside, wherein each of said grooves has a length at least part of which is oriented in an axial direction of the casing, a width measured in a circumferential direction, and a depth, and wherein the width of each of said grooves is equal to or greater than the depth thereof.

2. A turbo machine as defined in the claim 1, wherein said grooves comprise approximately 30% to 50% of a total circumference of said casing on which said grooves are formed.

3. A turbo machine as defined in the claim 1, wherein said grooves have a depth measured in a radial direction of said casing of approximately 0.5% to 1.6% of a diameter of said casing.

4. A turbo machine comprising:

a casing having a flow surface defined therein;

an impeller having a plurality of blades and being positioned within said casing;

a plurality of grooves being formed in the flow surface of said casing in radial direction thereof, for connecting between an inlet side of said impeller and an area in which the blades of said impeller reside in a gradient direction of fluid pressure therein, wherein each of said grooves is at least equal to 5 mm or greater than that in a width, and a terminal position at downstream side of each of said grooves is located in such a manner that fluid can be obtained under pressure being necessary to suppress generation of swirl at a terminal position of each of said grooves at upstream side thereof, wherein each of said grooves has a length at least part of which is oriented in an axial direction of the casing, a width measured in a circumferential direction, and a depth, and wherein the width of each of said grooves is equal or greater than the depth thereof.

5. A turbo machine comprising:

a casing having a flow surface defined therein;

an impeller having a plurality of blades and being positioned within said casing;

a plurality of grooves being formed in the flow surface of said casing, for connecting between a region where swirl may be generated at an inlet side of said impeller and an area in which the blades of said impeller reside in a direction of pressure gradient of the fluid, wherein each of said grooves is at least equal to 55 mm or greater than that in width thereof, and a terminal position at downstream side of each said groove is located in such a manner that fluid can be obtained under pressure being necessary to suppress generation of the swirl at a terminal position at upstream side of each said groove, thereby removing a behavior of uprising oat the right-hand side from a head-flow rate characteristic curve of said turbo machine, wherein each of said grooves has a length at least part of which is oriented in an axial direction of the casing, a width measured in a circumferential direction, and a depth, and wherein the width of each of said grooves is equal or greater than depth thereof.

6. A turbo machine comprising:

an impeller having a plurality of blades therewith;

a casing having a flow surface defined therein and being positioned with said impeller therein; and a plurality of grooves being formed on the flow surface of said casing, opposing to an outer peripheral portion of said impeller at an inlet side of the blades thereof, for connecting between an inlet side of said impeller and an area on the flow surface of said casing in which the blades of said impeller reside, on a periphery thereof, wherein:

each of said grooves has a length at least a part of which is oriented in an axial direction of the casing and a width measured in a circumferential direction of the casing, and wherein a terminal position at downstream side of each of said grooves is located in such a manner that fluid can be obtained under pressure being necessary to suppress generation of the swirl in inlet main flow at a terminal position, at upstream side of each of said grooves, thereby removing a behavior of uprising at the right-hand side from a head-flow rate characteristic curve of said turbo machine; and wherein said grooves are defined by a plurality of spaced ribs having a length at least part of which is oriented in the axial direction of the casing, the ribs being constructed separately from the casing and being fixed in a channel provided in the casing.

7. A turbo machine as defined in the claim 6, wherein the ribs are fixed to the casing by screws.

8. A turbo machine as defined in the claim 7, wherein the ribs are made of rubber.

9. A turbo machine as defined in the claim 7, wherein the ribs are made of a resin material.

10. A turbo machine as defined in the claim 7, wherein the ribs are spaced equidistantly.

11. A turbo machine as defined in the claim 7, wherein the ribs extend in the axial direction and are equidistantly spaced in the circumferential direction.

12. A turbo machine as defined in the claim 6, wherein the ribs are fixed to the casing by adhesive.

13. A turbo machine as defined in the claim 6, wherein the ribs are fixed to the casing by welding.

14. A turbo machine as defined in the claim 6, wherein the ribs are fixed to the casing by spot welding.

15. A turbo machine as defined in the claim 6, wherein the ribs are fixed to the casing by projection welding.

16. A turbo machine as defined in claim 6, wherein each of said grooves has a width of at least 5 mm.

17. A method for manufacturing a turbo machine, comprising:

providing a casing having a flow surface defined therein and a channel provided in the flow surface;

providing a plurality of ribs in the channel, each of the ribs being arranged in the channel so as to have a length at least a part of which is oriented in an axial direction of the casing, the ribs being spaced from one another to define a plurality of grooves therebetween, each of the grooves having a length at least a part of which is oriented in the axial direction of the casing and a width measured in a circumferential direction of the casing;

fixing the ribs in the channel; and positioning an impeller having a plurality of blades within the casing such that the plurality of grooves oppose an outer peripheral portion of said impeller at an inlet side thereof, for connecting between an inlet side of said impeller and an area on the flow surface of the casing in which the blades of the impeller reside, on a periphery thereof; wherein a terminal position at a downstream side of each of the grooves is located in such a manner that fluid can be obtained under pressure being necessary to suppress generation of swirl in inlet main flow at a terminal position at an upstream side of each of the grooves, thereby removing a behavior of uprising at the right-hand side from a head-flow rate characteristic curve of the turbo machine.

18. A method as defined in the claim 17, wherein the ribs are fixed to the casing by screws.

19. A method as defined in the claim 17, wherein the ribs are fixed to the casing by adhesive.

20. A method as defined in the claim 17, wherein the ribs are fixed to the casing by welding.

21. A method as defined in the claim 17, wherein the ribs are fixed to the casing by spot welding.

22. A method as defined in the claim 17, wherein the ribs are fixed to the casing by projection welding.

23. A method as defined in the claim 17, wherein the ribs are made of rubber.

24. A method as defined in the claim 17, wherein the ribs are made of a resin material.

25. A method as defined in the claim 17, wherein the ribs are spaced equidistantly.

26. A method as defined in the claim 17, wherein the ribs extend in the axial direction and are equidistantly spaced in the circumferential direction.

* * * * *